US010308380B2

(12) United States Patent
Holland-Letz et al.

(10) Patent No.: US 10,308,380 B2
(45) Date of Patent: Jun. 4, 2019

(54) DEVICE FOR FILLING A THIN-WALLED TRANSPORT CONTAINER WITH SECURITIES

(71) Applicant: Wincor Nixdorf International GmbH, Paderborn (DE)

(72) Inventors: Günter Holland-Letz, Paderborn (DE); Dirk Langhuber, Paderborn (DE)

(73) Assignee: Wincor Nixdorf International GmbH, Paderborn (DE)

( * ) Notice: Subject to any disclaimer, the term of this patent is extended or adjusted under 35 U.S.C. 154(b) by 684 days.

(21) Appl. No.: 14/755,623

(22) Filed: Jun. 30, 2015

(65) Prior Publication Data

US 2015/0298832 A1 Oct. 22, 2015

Related U.S. Application Data

(62) Division of application No. 13/260,000, filed as application No. PCT/EP2010/053508 on Mar. 18, 2010, now Pat. No. 9,114,952.

(30) Foreign Application Priority Data

Mar. 26, 2009 (DE) ..... 10 2009 015 047

(51) Int. Cl.
*B65B 5/12* (2006.01)
*G07D 11/13* (2019.01)
(Continued)

(52) U.S. Cl.
CPC ..... *B65B 5/12* (2013.01); *B65B 5/108* (2013.01); *B65B 7/2842* (2013.01); *B65B 25/14* (2013.01);
(Continued)

(58) Field of Classification Search
CPC ..... B65B 5/12; B65B 5/108; B65B 7/2842; B65B 25/14; B65B 35/50; B65H 1/00;
(Continued)

(56) References Cited

U.S. PATENT DOCUMENTS 3,044,231 A 7/1962 Blais et al.
3,188,945 A 6/1965 Renauer
(Continued)

FOREIGN PATENT DOCUMENTS

CN 1886297 A 12/2006
DE 2345151 A1 3/1975
(Continued)

OTHER PUBLICATIONS

Search Report from State Intellectual Property Office (SIPO) of People's Republic China for Application No. 201310486586.2 (2 pages).
(Continued)

*Primary Examiner* — Sameh Tawfik
(74) *Attorney, Agent, or Firm* — Black, McCuskey, Souers & Arbagh LPA

(57) ABSTRACT

The invention relates to a device (10) for filling a thin-walled transport container (12) with notes of value. The device (10) comprises a supply unit (100) for supplying the notes of value and a stacking unit (200) for stacking the supplied notes of value. Further, the device (10) comprises a receiving unit (400) for receiving the thin-walled transport container (12), a holding unit (600) for holding a first closing element (18) and a second closing element (20) for closing the thin-walled transport container (12), a displacement unit (700) for displacing a value note stack created by means of the stacking unit (200) into the thin-walled transport container (12), a retaining unit (500) for holding notes of value transported into the thin-walled transport container (12) in
(Continued)

the orientation in which they have been supplied to the transport container (12) and/or a closure unit (300) for closing a closing unit (16) for closing the opening of the thin-walled transport container (12).

7 Claims, 22 Drawing Sheets

(51) Int. Cl.

| | |
|---|---|
| ***G07D 11/40*** | (2019.01) |
| ***B65B 5/10*** | (2006.01) |
| ***B65B 25/14*** | (2006.01) |
| ***B65H 31/22*** | (2006.01) |
| ***B65H 29/40*** | (2006.01) |
| ***B65H 31/06*** | (2006.01) |
| ***B65B 7/28*** | (2006.01) |
| ***B65B 35/50*** | (2006.01) |
| ***B65H 1/00*** | (2006.01) |
| ***B65H 31/00*** | (2006.01) |

(52) U.S. Cl.
CPC ..... *B65B 35/50* (2013.01); *B65H 1/00* (2013.01); *B65H 29/40* (2013.01); *B65H 31/00* (2013.01); *B65H 31/06* (2013.01); *B65H 31/22* (2013.01); *G07D 11/13* (2019.01); *G07D 11/40* (2019.01); *B65H 2405/311* (2013.01); *B65H 2405/32* (2013.01); *B65H 2701/1912* (2013.01)

(58) Field of Classification Search
CPC ..... B65H 29/40; B65H 31/00; B65H 31/06; B65H 31/22; B65H 2405/311; B65H 2405/32; B65H 2701/1912; G07D 11/0012; G07D 11/0081
USPC ..... 53/540
See application file for complete search history.

(56) References Cited

U.S. PATENT DOCUMENTS

| | | | | | |
|---|---|---|---|---|---|
| 3,747,754 | A | | 7/1973 | Nix et al. | |
| 4,045,017 | A | | 8/1977 | Lundblad | |
| 4,596,924 | A | * | 6/1986 | Watanabe | G07D 11/0081 235/379 |
| 4,617,784 | A | * | 10/1986 | Golicz | B65B 27/08 53/228 |
| 4,930,293 | A | * | 6/1990 | Hanscom | B65B 11/02 53/590 |
| 5,126,002 | A | | 6/1992 | Iwata et al. | |
| 5,186,334 | A | * | 2/1993 | Fukudome | G07D 11/0081 209/534 |
| 5,251,738 | A | | 10/1993 | Dabrowski | |
| 5,421,700 | A | * | 6/1995 | Kranz | B65H 29/40 271/2 |
| 5,641,157 | A | * | 6/1997 | Mays | G07D 11/0012 271/181 |
| 5,675,963 | A | * | 10/1997 | Nicholson | B65B 5/061 53/247 |
| 5,996,314 | A | | 12/1999 | Pennini et al. | |
| 6,826,891 | B2 | * | 12/2004 | Sauer | B65B 27/08 100/17 |
| 7,677,546 | B2 | * | 3/2010 | Saltsov | B65H 29/006 194/206 |
| 2003/0180131 | A1 | | 9/2003 | Lewis | |
| 2007/0102439 | A1 | | 5/2007 | Bell | |
| 2007/0145064 | A1 | | 6/2007 | Clauser et al. | |
| 2011/0052363 | A1 | | 3/2011 | Brexel et al. | |
| 2012/0167529 | A1 | * | 7/2012 | Langhuber | B65B 11/08 53/467 |
| 2014/0001703 | A1 | | 1/2014 | Petermann et al. | |
| 2014/0331612 | A1 | * | 11/2014 | Jeschke | B65H 31/309 53/447 |

FOREIGN PATENT DOCUMENTS

| | | | |
|---|---|---|---|
| DE | 2520756 | A1 | 11/1975 |
| DE | 4224223 | A1 | 1/1994 |
| DE | 4224223 | A1 | 1/1994 |
| DE | 102008061529 | A1 | 6/2010 |
| DE | 102008061530 | A1 | 6/2010 |
| EP | 0257978 | A2 | 3/1988 |
| EP | 0271042 | A2 | 6/1988 |
| EP | 0852279 | A2 | 7/1998 |
| EP | 0852279 | A2 | 8/1998 |
| EP | 1331189 | B1 | 8/2006 |
| FR | 2419219 | A1 | 10/1979 |
| FR | 2903210 | A1 | 1/2008 |
| GB | 2439809 | A | 1/2008 |
| JP | 2949301 | B2 | 9/1999 |
| WO | 2010066741 | A1 | 6/2010 |

OTHER PUBLICATIONS

International Search (in English) and Written Opinion of the International Searching Authority (in German) for PCT/EP2010/053508, dated Jan. 14, 2011, ISA/EP.
Translation of International Preliminary Report on Patentability for PCT/EP2010/053508 dated Oct. 6, 2011 (11 pages).
Chinese Search Report for Application No. 2013-10486548.7 dated Jun. 18, 2015 (2 pages).
Communication pursuant to Article 94(3) EPC issued in the corresponding European application, 6pages.

* cited by examiner

DEVICE FOR FILLING A THIN-WALLED TRANSPORT CONTAINER WITH SECURITIES

CROSS-REFERENCE TO RELATED APPLICATIONS

This application is a Divisional application of U.S. application Ser. No. 13/260,000, filed Dec. 7, 2011, which is a U.S. National Stage of International Application No. PCT/EP2010/053508, filed Mar. 18, 2010 and published in German as WO 2010/108841 A2 on Sep. 30, 2010. This application claims the benefit and priority of German Application No. 102009015047.1, filed Mar. 26, 2009. The entire disclosures of the above applications are incorporated herein by reference.

This section provides background information related to the present disclosure which is not necessarily prior art.

BACKGROUND

Technical Field

The invention relates to a device for filling a thin-walled transport container with notes of value. The device comprises a supply unit for supplying the notes of value and a stacking unit for stacking the supplied notes of value.

Discussion

The device according to the invention is in particular used in automated teller machines, preferably cash deposit machines, and automatic cash safes into which notes of value are deposited. The deposited notes of value are deposited, for example dependent on their value and/or their size, in transport containers. As transport containers, in particular cash boxes and thin-walled transport containers are used. The notes of value are stored in a stacked manner in the transport containers, and the transport containers are closed after filling with the notes of value. The closed transport containers are removed from the automated teller machine or, respectively, the automatic cash system by a security transport company.

SUMMARY OF THE INVENTION

It is an object of the invention to specify a device for filling a thin-walled transport container with notes of value, which device has a simple and compact design, is easy to handle and by means of which notes of value can be stacked into the respective transport container in an orderly manner.

A first aspect of the invention relates to a device for filling a thin-walled transport container with notes of value, comprising a supply unit for supplying the notes of value, a stacking unit for stacking the supplied notes of value and a receiving unit for receiving the thin-walled transport container. The receiving unit includes a carrier unit which is pivotable about an axis of rotation. When filled with notes of value, the thin-walled transport container rests on at least a part of the carrier unit when the carrier unit is pivoted about the axis of rotation. The carrier unit is in particular a plate on which the transport container filled with notes of value rests. By pivoting the carrier unit and thus the transport container about the axis of rotation, an easy handling of the device is achieved. In particular, in this way the removal of a filled transport container and the insertion of a new unfilled transport container into the device is made easier.

It is advantageous to provide two side elements for the lateral guidance of the thin-walled transport container, which side elements extend transversely to the carrier unit and are connected to the longitudinal edges of the carrier unit. The carrier unit and the side elements thus form a tub having a U-shaped basic form. The filled transport container is arranged within this tub, as a result whereof a lateral slipping of the filled transport container is prevented. An empty thin-walled transport container can then be put over the U-shaped tub with its inside surface turned outside. When the notes of value are supplied into the transport container, then the outside-turned inside surface of the thin-walled transport container is again turned inside.

Such a method for filling a thin-walled transport container is disclosed is the non-prepublished document DE 10 2008 061 530. The description of the method suggested in document DE 10 2008 061 530 for filling at least one thin-walled transport container and the device suggested in the same document for storing at least one article of value are herewith incorporated into this description by reference. The receiving area for receiving the notes of value formed by turning the outside-turned inside surface to the inside is arranged within the U-shaped tub. The side elements form a separation between the part of the thin-walled transport container having its inside surface turned outside and the part of the transport container having its inside surface again turned inside.

In a preferred embodiment of the invention a translation unit for moving the carrier unit in at least one direction is provided. The translation unit is in particular formed by two rails and a slide arranged on these rails so as to be movable in their longitudinal direction. The carrier unit can be pivotally connected to the slide by means of an axis, the axis forming the axis of rotation. By the combination of a translational movement and the swivel movement, the handling is made even more easier. On the rails, the slide and the carrier unit connected to the slide and thus also the thin-walled transport container can be pulled out of the system in which the device for filling the thin-walled transport container is arranged. By pivoting the carrier unit and thus the thin-walled transport container upward relative to the slide, the filled thin-walled transport container can be removed easily.

It is particularly advantageous to provide a locking element by means of which the carrier unit can be locked in a removal position at a preset angle relative to the slide. In this way, it is achieved that when a filled thin-walled transport container is removed and/or a new empty transport container is inserted into the device by an operator, in particular by an employee of a security transport company, the carrier unit need not be manually held in the removal position. This reduces the risk of injury, and the course of exchanging a filled transport container against a new transport container is made easier. The preset angle preferably has a value in the range between 20° and 60°.

A second aspect of the invention relates to a device for filling a thin-walled transport container with notes of value. The device comprises a supply unit for supplying the notes of value, a stacking unit for stacking the supplied notes of value and a holding unit for holding a first closing element and a second closing element in a preset supply position in which notes of value can be supplied to the thin-walled transport container. The first closing element and the second closing element serve to close the thin-walled transport container when filled with notes of value. The holding unit includes a first holding element which contacts a first end of the first closing element and a second holding element which contacts a second end of the first closing element that is opposite to the first end. Further, the holding unit includes a third holding element which contacts a first end of the second closing element and a fourth holding element which contacts a second end of the second closing element that is opposite to the first end. Further, the holding unit includes an elastic element which, via the holding elements, keeps the closing elements at a preset minimum distance to each other at least during filling of the transport container. The preset minimum distance is preferably at least as long as the short sides of the note of value having the longest short side of all notes of value to be received in the thin-walled transport container.

By the second aspect of the invention, it is achieved that all notes of value to be supplied to the thin-walled transport container can be supplied thereto in a problem-free manner. By the elastic element, it is achieved that the closing elements can be moved toward each other during the closing of the filled transport container, without these having to be removed from the holding elements. Further, by means of the elastic element an easy insertion of the closing elements and the thin-walled transport container into the holding unit is achieved.

The first closing element preferably comprises several first snap-in elements, and the second closing element comprises several second snap-in elements that are complementary to the first snap-in elements. When the opening of the thin-walled transport container is closed by means of the closing elements, the first snap-in elements of the first closing element snap into the second snap-in elements of the second closing element. In this way, a revision-safe closing of the thin-walled transport container is achieved, as a result whereof manipulations are prevented or at least recognized easily and immediately. The two closing elements are preferably connected to each other via two connecting elements so that the two closing elements together with the connecting elements form a closed frame. The frame is in particular formed as one piece. The structure and the function of the closing elements and the frame are described in detail in the non-prepublished document DE 10 2008 061 529. The description of the device and of the method for closing at least one thin-walled transport container having at least one opening according to document DE 10 2008 061 529 is herewith incorporated into this description by reference.

In a preferred embodiment of the invention, a receiving unit for receiving the thin-walled transport container is provided. The receiving unit is in particular designed such as described herein.

It is advantageous when the first holding element and the third holding element are connected to each other via a first elastic element, and the second holding element and the fourth holding element are connected to each other via a second elastic element. In this way, the preset minimum distance between the closing elements held via the holding elements is created easily. Additionally or alternatively, the first holding element can be connected to the receiving unit by means of a third elastic element, the second holding element can be connected to the receiving unit by means of a fourth elastic element, the third holding element can be connected to the receiving unit by means of a fifth elastic element, and the fourth holding element can be connected to the receiving unit by means of a sixth elastic element.

The first, the second, the third, the fourth, the fifth and/or the sixth elastic element preferably comprise one spring each. As springs, in particular, wound torsion springs, preferably tension springs, and/or gas-pressure springs are used. Such springs can be obtained easily and cost-efficiently.

Further, it is advantageous when the holding elements are movably arranged so that the first closing element and/or the second closing element for closing the thin-walled transport container are movable relative to each other such that the snap-in elements of the closing elements snap into each other. In this way, it is achieved that the closing elements snap into each other, without the contact to the holding elements having to be interrupted. In this way, a uniform guidance of the closing elements during closing is achieved by the holding elements.

A third aspect of the invention relates to a device for filling a thin-walled transport container having an opening with notes of value. This device comprises a supply unit for supplying the notes of value, a stacking unit for stacking the supplied notes of value and a displacement unit for displacing a value note stack created by means of the stacking unit into the thin-walled transport container. The displacement unit displaces the value note stack into the transport container at least so far that between the opening of the transport container and the note of value supplied to the transport container as last note of value a preset minimum distance exists. By displacement of the value note stack, both a displacement of a value note stack created outside the transport container by means of the stacking unit into the transport container and a displacement of a value note stack already present in the transport container are understood. The value note stack is thus pushed into the transport container or further pushed into the transport container. The displacement of the value note stack thus takes place in stacking direction. The stacking direction is the direction in which the dimension of the value note stack increases when further notes of value are supplied by the stacking unit.

It is advantageous when the stacking unit comprises at least one vane wheel. The stacking unit preferably comprises at least three vane wheels. The vane wheels are also referred to as stacking wheels. Such a vane wheel has elastic vanes curved in a circumferential direction, which vanes, together with the respective adjacent vane, form a receiving area for receiving a note of value. Each of the collected notes of value is conveyed into a receiving area of the rotating vane wheel at a high speed and, after a partial rotation of the vane wheel, is again stripped off of the respective receiving area.

Further, it is advantageous when a support element is provided on which the notes of value of the value note stack created by means of the stacking unit are arranged in an upright position on one of their longitudinal edges. By arranging the notes of value of the value note stack in an upright position on one of their longitudinal edges, an easy handling of the notes of value and a compact design of the device are achieved. In an alternative embodiment of the invention, the notes of value can be arranged in an upright position on one of their short edges.

When the value note stack is displaced into the transport container, the value note stack preferably slides over the support element. In this way, it is achieved that the value note stack can be transported into the opening of the thin-walled transport container without one or several of the notes of value of the value note stack getting caught on components arranged in front of the opening or without notes of value of the value note stack getting lost during transport.

It is particularly advantageous when, in a first position, the support element is arranged partially within the opening of the transport container and when, in a second position, the support element is completely arranged outside the opening. By means of a swivel device by which the support element is pivotable about an axis of rotation, the support element is in particular pivoted between the first and the second position. In the first position, a safe transport of the value note stack into the transport container is guaranteed. The notes of value can in particular not fall into a gap in front of the opening of the transport container. By arranging the support element outside the opening in the second position, it is achieved that the opening can be closed by means of the two closing elements.

In a preferred embodiment of the third aspect, the displacement unit comprises an L-shaped element, preferably several L-shaped elements. Here, a contact area of a first leg of the L-shaped element can contact the value note stack during displacement of the value note stack. The second leg of the L-shaped element is at least as long as the preset minimum distance. In this way, on the one hand, a sufficiently large contact area between the displacement unit and the value note stack to be displaced is achieved and, on the other hand, it is easily guaranteed that the minimum distance is kept.

In addition, it is advantageous to provide a drive unit that moves a press-on area of the displacement unit into the opening of the transport container and out of the opening of the transport container. The press-on area of the displacement unit is in particular the area by means of which the value note stack, via the contact with the press-on area, is pushed into the transport container or further into the transport container. The displacement unit is in particular displaced by means of two toothed belts guided over several deflection elements.

A fourth aspect of the invention relates to a device for filling a thin-walled transport container with notes of value. The device comprises a supply unit for supplying the notes of value, a stacking unit for stacking the supplied notes of value and a retaining unit for holding notes of value transported into the thin-walled transport container in the orientation in which they have been supplied into the transport container. The retaining unit includes a retaining element which is arranged outside the transport container and pivotable about an axis of rotation. In a first position, the retaining element is arranged such that the notes of value can be supplied to the transport container. In a second position, the retaining element deforms the transport container such that the notes of value received in the transport container are held in an upright position on their longitudinal edges. In this way, in particular a tipping over of the notes of value opposite to the supply direction of the notes of value is prevented. By means of the retaining element it is achieved that the notes of value substantially remain in the orientation in which they have been supplied to the transport container, even when the displacement unit by means of which the notes of value have been displaced into the transport container no longer contacts the notes of value.

The retaining element is preferably a rod clamped in on both sides, in particular a round rod, the length of which is preferably longer than the width of the filled thin-walled transport container. The rod is in particular arranged above the upper side of the thin-walled transport container. By a slight lowering of the rod, the thin-walled transport container is deformed over its entire width such that the notes of value arranged therein cannot tip over. For this, the rod is in particular arranged such that the distance of the rod to the opening of the thin-walled transport container is smaller than the minimum distance at which the notes of value displaced into the transport container by means of the displacement unit are arranged relative to the opening.

It is advantageous when the retaining element does not deform the thin-walled transport container in the first position, and presses into the thin-walled transport container in the second position. It is particularly advantageous when the retaining element does not contact the thin-walled transport container in the first position.

A fifth aspect of the invention relates to a device for filling a thin-walled transport container having an opening with notes of value, which device comprises a supply unit for supplying the notes of value. The device comprises a stacking unit for stacking the supplied notes of value and a closure unit for closing a closing unit. By means of the closing elements of the closing unit, the opening of the thin-walled transport container is closed. The closure unit includes a first press-on element and a second press-on element that is arranged parallel to the first press-on element. For closing the closing unit, the first press-on element exerts a force on a first closing element of the closing unit. The second press-on element exerts a force on a second closing element of the closing unit and/or supports the second closing element. The exertion of a force on one of the closing elements can be both an active exertion of a force (actio) and the response to a force exerted on the closing element in the form of a counterforce (reactio). The first closing element is mounted such that for closing the closing unit it is movable in the direction of the second closing element so far that the closing unit is closed by bringing the two closing elements together. Via the press-on elements, the force that is required for the snap-in of the first snap-in elements of the first closing element into the second snap-in elements of the second closing element is exerted on the closing unit. In this way, a revision-safe closing of the opening of the thin-walled transport container is guaranteed.

It is advantageous when the press-on elements are mounted such that for closing the closing unit the first press-on element is movable in the direction of the second press-on element and the second press-on element is movable in the direction of the first press-on element. It is particularly advantageous when the distance by which the first press-on element is moved in the direction of the second press-on element and the distance by which the second press-on element is moved in the direction of the first press-on element are identical. In this way, it is achieved that the closing unit is closed approximately in the middle of the opening of the transport container. Thus, a uniform reliable closing of the opening of the thin-walled transport container is guaranteed.

The first press-on element and the second press-on element preferably each comprise a stiffening element for increasing the bending stiffness. The stiffening elements cause that the press-on elements do not bend when the force required for the snap-in of the first snap-in elements of the first closing element into the second snap-in elements of the second closing element is exerted on the closing elements. In this way, it is achieved that the required force is transmitted and that the snap-in of the closing elements into one another is guaranteed.

It is advantageous when the first press-on element and the second press-on element each have an L-shaped profile at least in a part thereof. Thus, the required bending stiffness is achieved easily. It is particularly advantageous when a first leg of the first press-on element and a first leg of the second press-on element are arranged in an overlapping fashion or next to each other when the first press-on element and the second press-on element are in an end position in which they have been moved toward each other. The end position is the position in which the two press-on elements have been moved toward each other so far that the snap-in elements of the two closing elements snap into each other. Thus, it is achieved that the two first legs of the two press-on elements do not impede each other in the end position and therefore that the press-on elements can be moved closer to each other.

Further, it is advantageous to provide a drive unit for moving the press-on elements. The drive unit in particular comprises an electric motor, preferably a stepper motor. The first press-on element and/or the second press-on element are preferably connected to the drive unit via one toggle joint each. By this toggle joint it is guaranteed that the force required for the snap-in of the closing elements is transmitted via the press-on elements to the closing elements. In an alternative embodiment also a link motion may be provided instead of the toggle joint.

The thin-walled transport container is in particular a bag, preferably a bag made of foil and/or tissue material. Such bags are easy to produce and can be obtained cost-efficiently. The notes of value are in particular banknotes.

A device having the features of one of the independent claims can be developed with the features or, respectively, one of the features of the other independent claims. Likewise, the device having the features of one of the independent claims can be developed in the same manner as the devices according to the other independent claims.

BRIEF DESCRIPTION OF THE DRAWINGS

Further features and advantages of the invention result from the following description which in connection with the enclosed Figures explains the invention in more detail with reference to embodiments.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
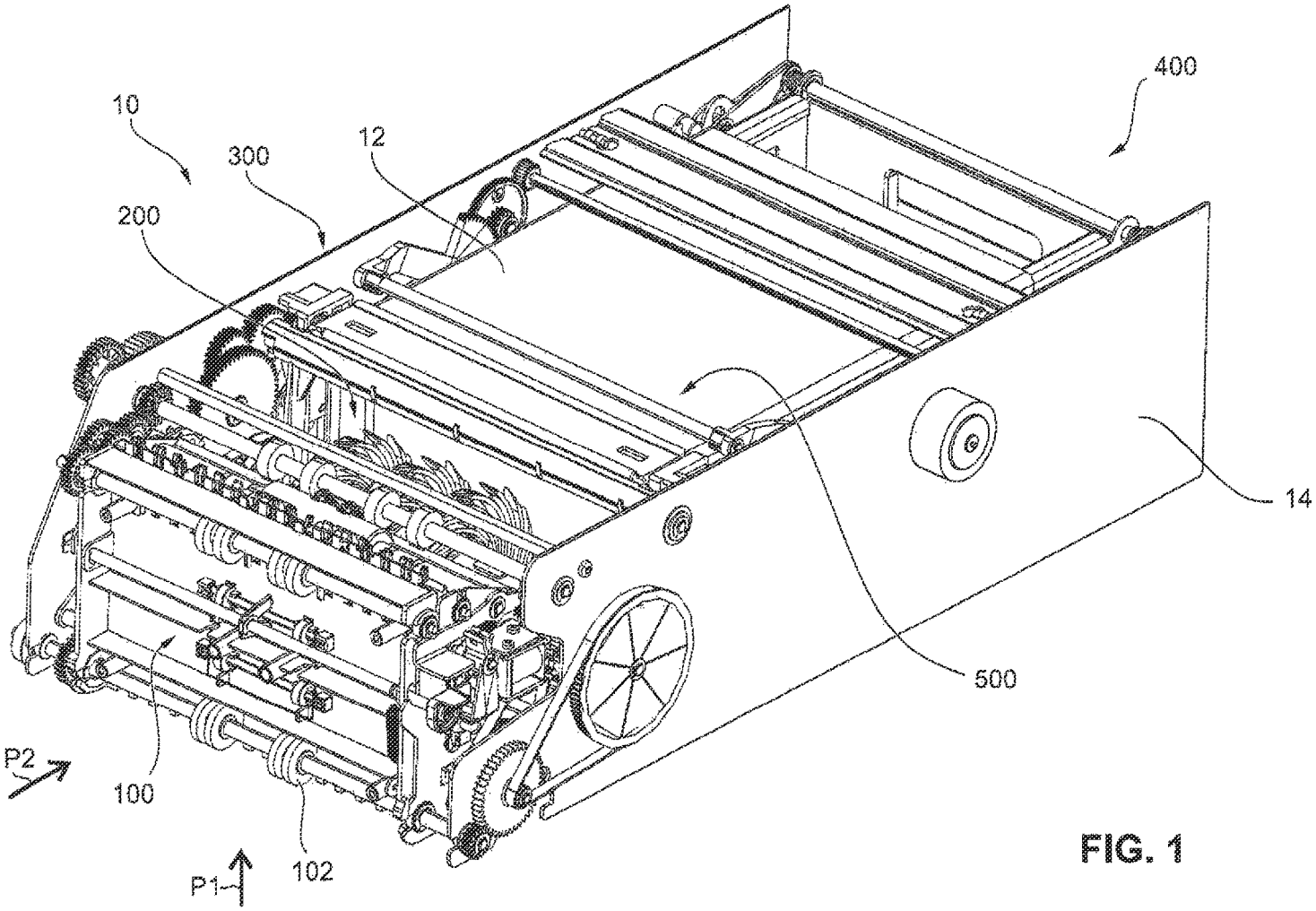
FIG. 1 is a schematic perspective front-view illustration of a device for filling a thin-walled transport container with notes of value.

In FIG. 1, a schematic perspective illustration of a device 10 for filling a thin-walled transport container 12 with notes of value is shown. The device 10 is in particular used in cash deposit machines, in automatic cash safes and in automatic cash systems, as well as in the back office area of retail businesses for the preparation of the value note takings prior to the handing over to a security transport company. The notes of value are in particular banknotes. Further, the notes of value can, for example, also be checks.

The thin-walled transport container 12 is in particular a bag, preferably a bag made of plastic foil and/or tissue material. The bag 12 is in particular made of polyethylene and has a wall thickness in the range between 0.05 mm and 0.1 mm. The bag 12 is also referred to as safebag and is preferably designed in the form of a block bottom bag, i.e. the bottom of the bag 12 is folded and thus inherently reinforced to keep its shape.

The bag 12 is in particular put over a frame 16 with its inside surface turned outside. When the bag 12 is filled with notes of value, the notes of value are transported against the bottom of the bag 12 or, respectively, against the notes of value already deposited in the bag 12, as a result whereof the inside surface of the bag 12 that is turned outside is again turned inside. In doing so, the bag 12 is guided over the frame 16 and transported through the opening of the frame 16 in a stepwise and/or continuous manner. The opening of the frame 16 is in particular rectangular and at least as large as the largest note of value to be received in the bag 12. Preferably, the opening of the frame 16 is slightly larger than the largest note of value to be received in the bag 12. Such a method and a device for filling a thin-walled transport container 12 are described in the non-prepublished document DE 10 2008 061 530, which is herewith incorporated into this description by reference.

The notes of value are stacked in the bag 12 in an orderly manner in that they form a stack of notes of value in an upright position on one of their longitudinal edges and with their front and rear sides lying against each other. In the bag 12, in particular, up to 2000 notes of value can be received. When all notes of value to be received in the bag 12 have been transported into the bag, the bag 12 is closed by means of the frame 16. Here, only the part of the bag 12 is closed in which the notes of value are arranged. In this way it is achieved that the orderly stack of notes of value is maintained also during removal of the bag 12 and the transport of the bag 12 and thus that the value note stack can be further processed automatically without any manual preparation. The frame 16 is preferably made of polypropylene or acrylonitrile butadiene styrene. The frame 16 comprises two closing elements 18, 20, the first closing element 18 comprising first snap-in elements and the second closing element 20 comprising the same number of second snap-in elements that are complementary to the first snap-in elements.

The first closing element 18 and the second closing element 20 are connected to each other via two connecting elements so that a closed frame 16 is formed. When the frame 16 and thus the opening of the bag 12 are closed, the two closing elements 18, 20 are moved toward each other such that the first snap-in elements snap into the second snap-in elements. Here the two side walls of the bag 12 are pierced through. The snap-in elements cannot be removed from the bag 12 without being broken. In this way, a revision-safe closing of the bag 12 is achieved. An opening of the closing elements 18, 20 of the frame 16 is not possible in a non-destructive manner and thus can be recognized easily. Possible manipulations can thus be recognized easily and immediately. Such a frame 16 is described in the non-prepublished document DE 10 2008 061 529. The device described in the document DE 10 2008 061 529 and the described method for closing at least one thin-walled transport container 12 having at least one opening are herewith incorporated into this description by reference. Alternatively, instead of a frame 16 also two separate closing elements 18, 20 can be used for closing the bag 12.

The device 10 comprises a supply unit 100, a stacking unit 200, a closure unit 300, a receiving unit 400, a retaining unit 500, a holding unit 600 not visible in FIG. 1, and a displacement unit 700 likewise not visible in FIG. 1. The individual units 100 to 700 and their functions will still be explained in more detail in the following in connection with FIGS. 5 to 22. The units 100 to 700 are received in a rack 14 that serves in particular to protect the units 100 to 700 and to mount the units 100 to 700 or, respectively, elements of the units 100 to 700.

By means of the supply unit 100, the notes of value to be deposited in the bag 12 are supplied to the stacking unit 200 that stacks the notes of value in the form of an orderly value note stack. The supply unit 100 is in particular a vertical transport by which the notes of value are transported in the direction of the arrow P1 and/or opposite to the direction of the arrow P1 vertically along a transport path. The supply unit 100 comprises a deflector by which the notes of value to be deposited in the bag 12 are diverted from the transport path and are supplied in the direction of the arrow P2 to the stacking unit 200. The transport of the notes of value in particular takes place by means of pairs of rolls. One roll of such a pair of rolls is, for example, identified with the reference sign 102. Alternatively or additionally, the transport of the notes of value can also take place by means of belt pairs and/or roller pairs.

The displacement unit 700 pushes the value note stack created by means of the stacking unit 200 through a supply opening into the bag 12 in the supply direction. In the illustration shown in FIG. 1, the bag 12 is received in the receiving unit 400. The frame 16 is spread apart and/or held open by means of the holding unit 500 so that the distance between the first closing element 18 of the frame 16 and the second closing element 20 of the frame 16 is at least so large that through the supply opening formed between the closing elements 18, 20 the largest note of value to be received in the bag 12 can be transported. For pushing the value note stack into the bag 12, a part of the displacement unit 700 is moved through the supply opening into the bag 12. The value note stack pushed into the bag 12 is held by the retaining element 500 approximately in the position in which it had been pushed into the bag 12. In particular, a tipping over of the value note stack opposite to the supply direction is prevented. Thus, it is achieved that the notes of value deposited in the bag 12 do not tip over even after the displacement unit 700 has been moved out of the bag 12. When all notes of value to be received in the bag 12 are received in the bag 12, then the bag 12 is closed by closing the frame 16 by means of the closure unit 300.

Figure 2:
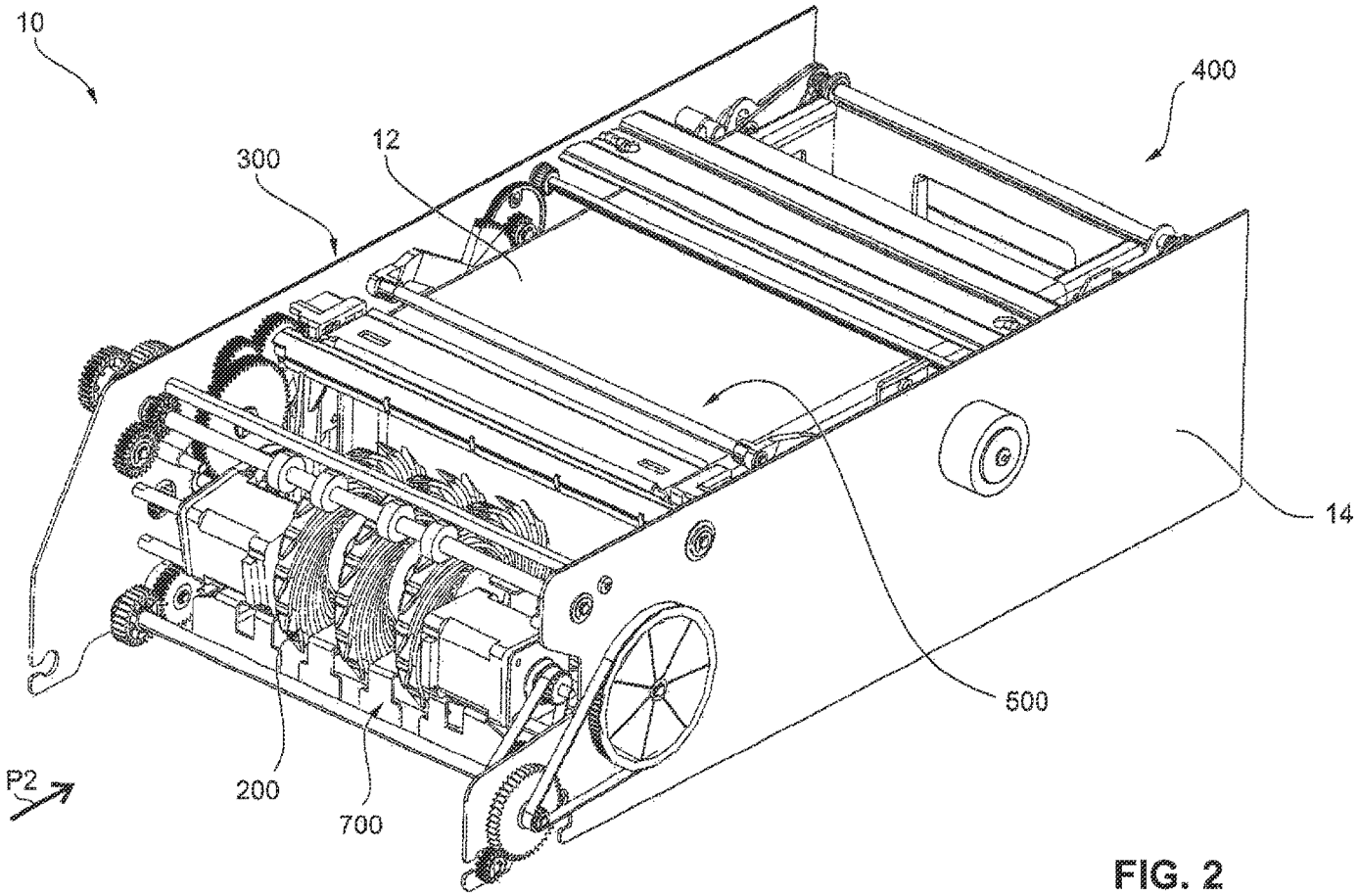
FIG. 2 is a schematic perspective illustration of the device according to FIG. 1 without a supply unit.

In FIG. 2, a schematic perspective illustration of the device 10 according to FIG. 1 without the supply unit 100 is shown so that the displacement unit 700 is visible. Elements having the same structure or the same function are identified with the same reference signs.

Figure 3:
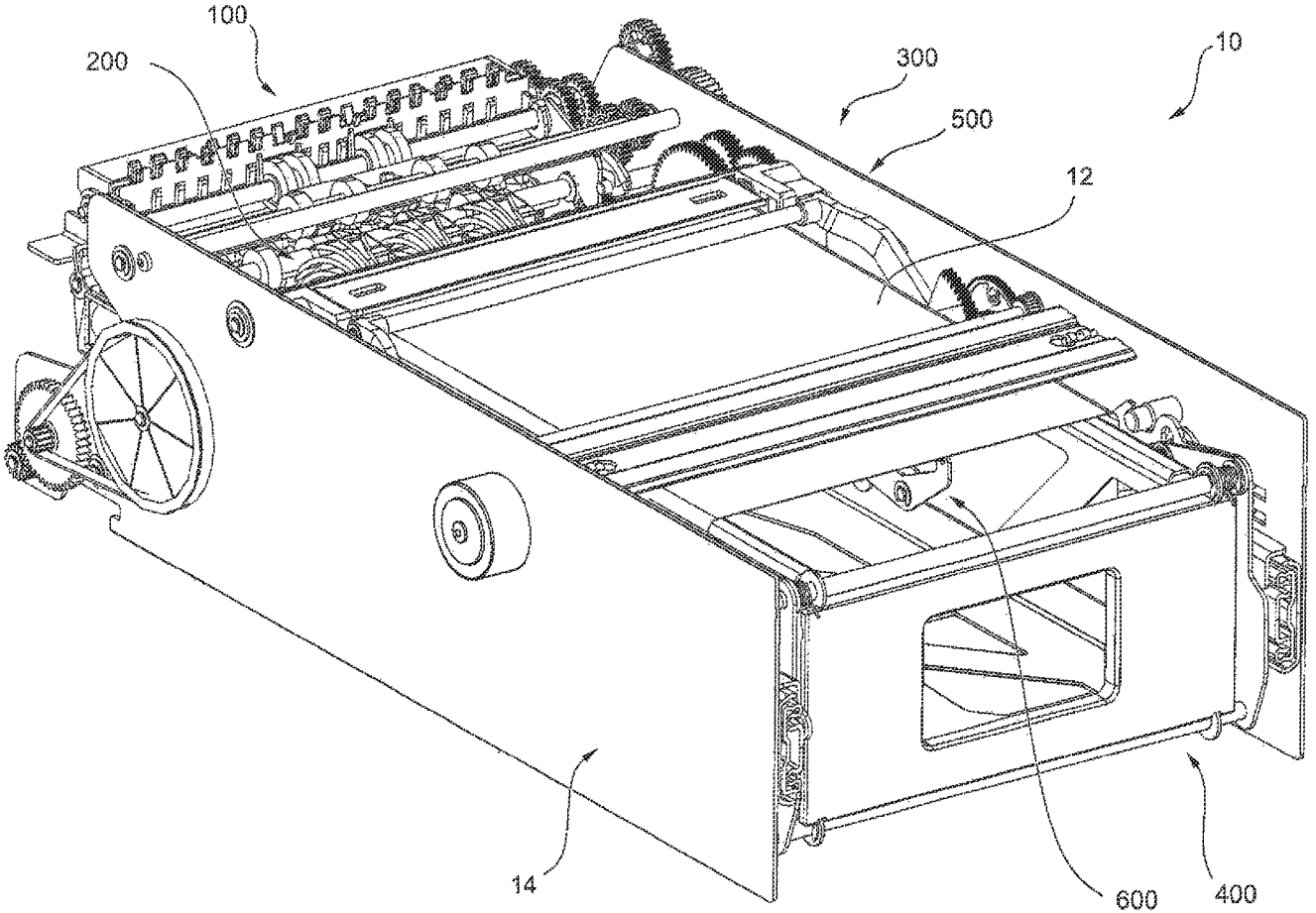
FIG. 3 is a schematic perspective rear-view illustration of the device according to FIGS. 1 and 2.

In FIG. 3, a schematic perspective rear-view illustration of the device 10 according to FIGS. 1 and 2 is shown. A part of the holding unit 600 arranged within the receiving unit 400 is visible in FIG. 3.

Figure 4:
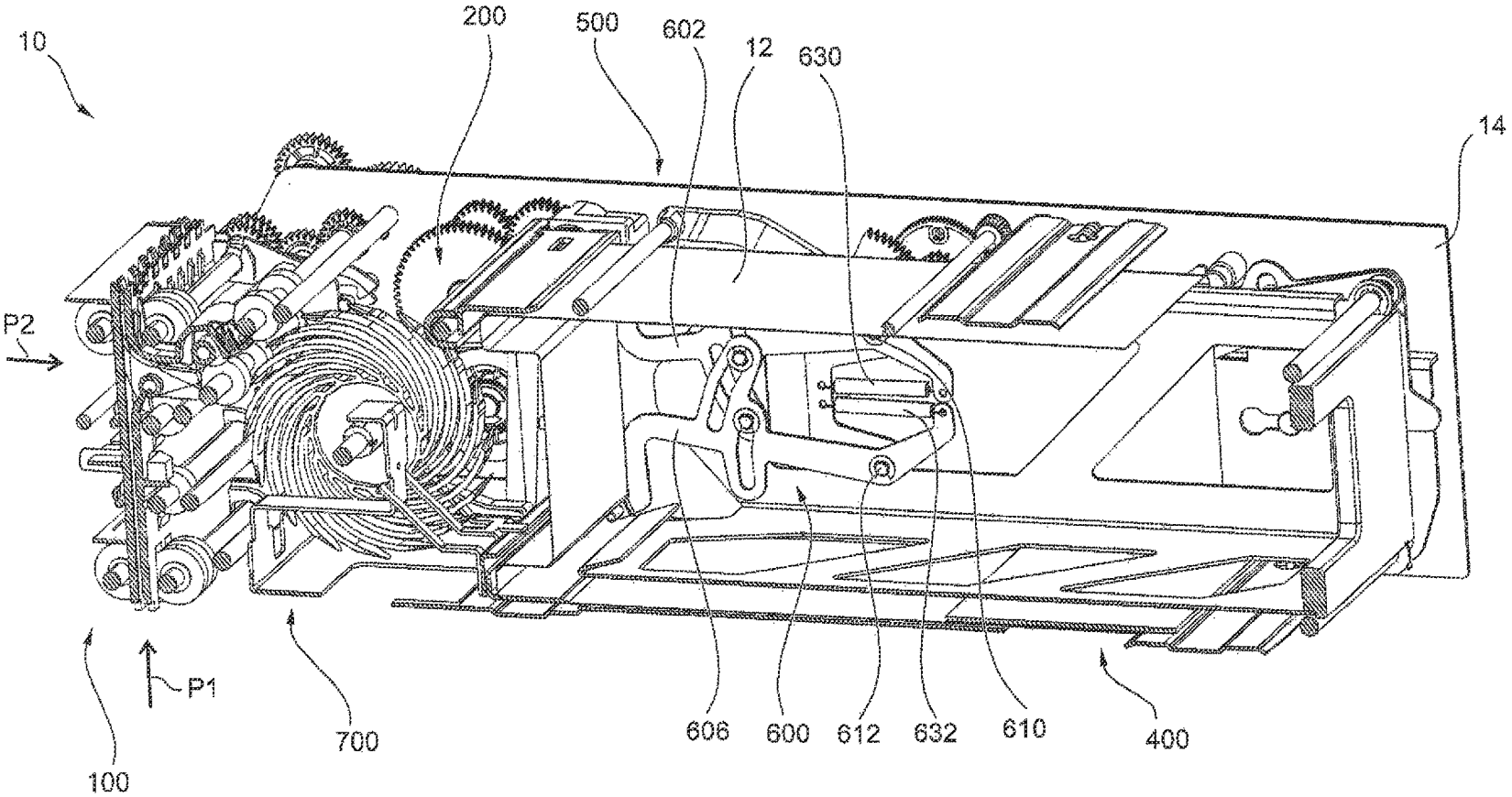
FIG. 4 is a schematic perspective illustration of a central longitudinal section of the device according to FIGS. 1 to 3.

In FIG. 4, a schematic perspective illustration of a central longitudinal section of the device 10 according to FIGS. 1 to 3 is shown. The frame 16 over which the bag 12 is put, is not shown in FIG. 4 for reasons of clarity. The entire device 10 is in particular dimensioned such that it is compatible to a cash box with respect to the installation space. For this, the outer dimensions of the device 10 are preferably identical to the dimensions of a cash box. In this way, it is achieved that in automated teller machines, a cash box can be replaced by the device 10 without major structural changes to the automated teller machine being necessary.

Figure 5:
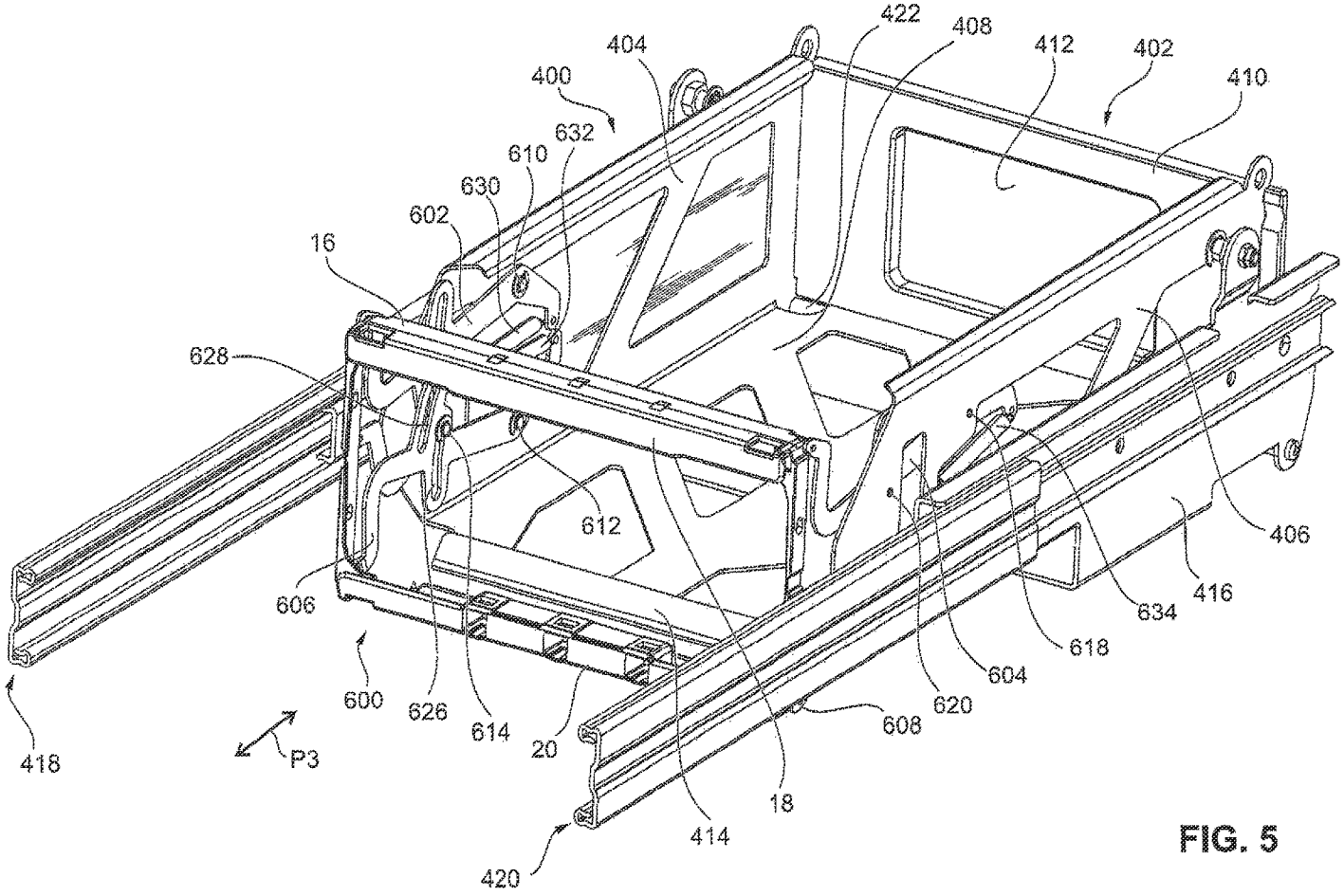
FIG. 5 is a schematic perspective illustration of a receiving unit of the device according to FIGS. 1 to 4 for receiving the thin-walled transport container, with a holding unit for holding a frame in a pulled-out position without a transport container.
Figure 6:
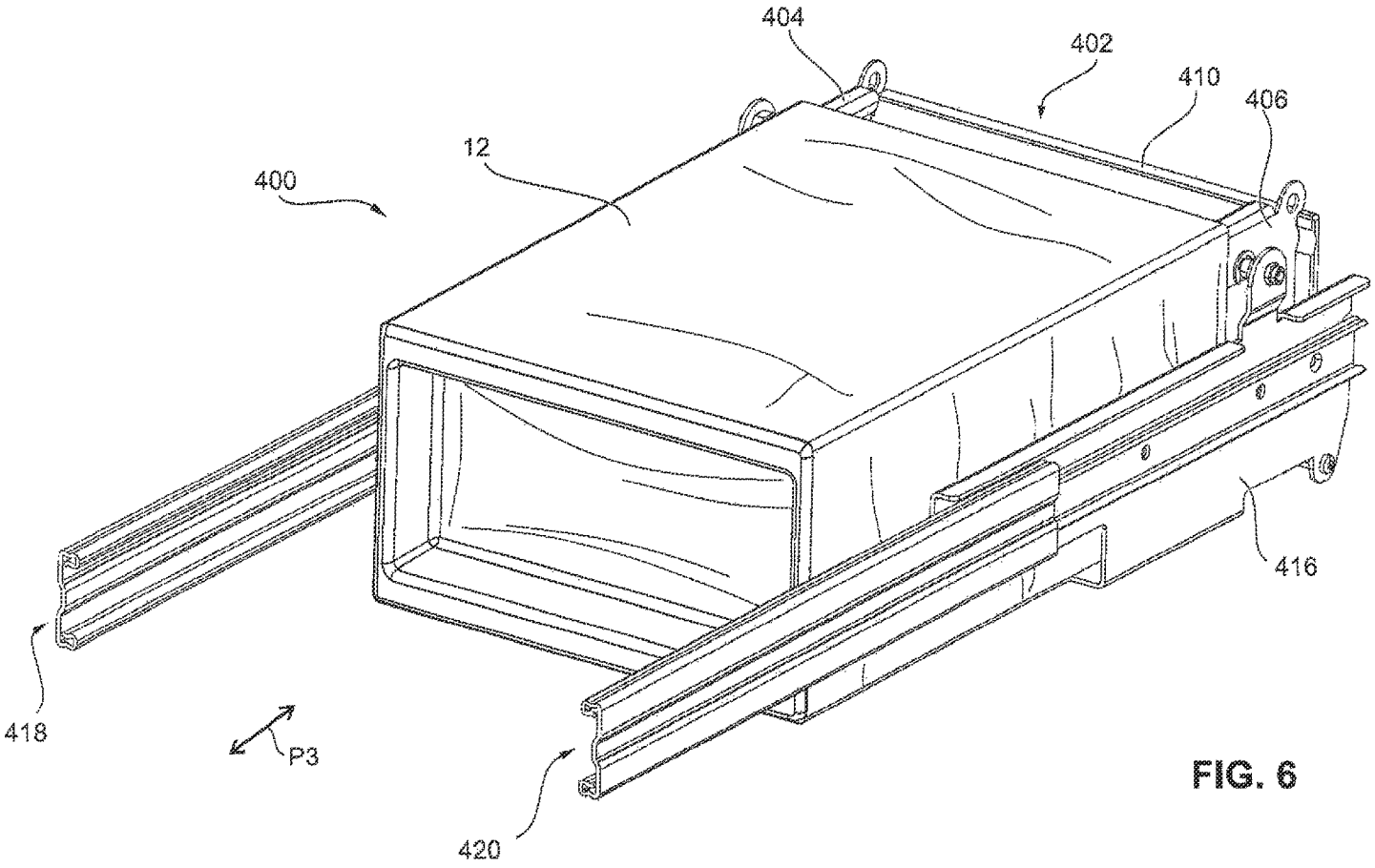
FIG. 6 is a schematic perspective illustration of the receiving unit and the holding unit according to FIG. 5 in the pulled-out position with a transport container.

In FIG. 5, a schematic perspective illustration of the receiving unit 400 and the holding unit 600 is shown in a pulled-out position of the receiving unit 400 without a bag 12, and shown with a bag 12 in FIG. 6. The holding unit 600 comprises four holding elements 602 to 608. The first holding element 602 contacts a first end of the first closing element 18 of the frame 16 and the second holding element 604 contacts a second end of the first closing element 18 that is opposite to the first end of the first closing element 18. Likewise, the third holding element 606 contacts a first end of the second closing element 20 and the fourth holding element 608 contacts a second end of the second closing element 20 that is opposite to the first end. The holding elements 602 to 608 are connected via connecting means 610 to 624 to side elements 404, 406 of the receiving unit 400 and are pivotally mounted relative to the side elements 404, 406. Each holding element 602 to 608 has two grooves, by which the swivel movement of the holding elements 602 to 608 is guided. The two grooves of the third holding element 606 are exemplarily identified with the reference signs 626 and 628. Further, each holding element 602 to 608 is connected via one spring 630 to 636 each to the respective side element 404, 406. The springs 630 to 636 are in particular tension springs. Alternatively, also other springs, in particular gas-pressure springs can be used. Additionally or alternatively to the springs 630 to 636, the first holding element 602 and the third holding element 606 as well as the second holding element 604 and the fourth holding element 608 can be connected to each other via one further elastic element each.

By the springs 630 to 636, the holding elements 602 to 608 are held in a first position, in which a frame 16 inserted into the holding unit 600 is at least spread apart so far that the first closing element 18 and the second closing element 20 have a distance to each other that is at least as large as the short sides of the note of value having the longest short side of all notes of value to be supplied to the bag 12. In this way, it is achieved that the notes of value can be supplied to a bag 12 that is put over the frame 16. As the holding elements 602 to 608 are pivotable, an easy mounting of the frame 16 is made possible.

When closing the frame 16, the closing elements 18, 20 are moved toward each other so that the first snap-in elements of the first closing element 18 snap into the second snap-in elements of the second closing element 20 and the opening of the bag 12 is closed. The holding elements 602 to 608 are pivotable such that they are moved toward each other during closing of the frame 16 and thus guide the first closing element 18 and the second closing element 20 during closing. Here, the first and the second holding element 602, 604 are pivoted downward, while the third and the fourth holding element 606, 608 are pivoted upward. When the frame 16 is closed, the frame 16 can easily be pulled off from the holding elements 602 to 608 so that the frame 16 can easily be removed from the device 10 together with the bag 12 closed by it. The holding elements 602 to 608 are in particular arranged such that the bag 12 is freely mounted around the circumference of the frame 16 so that, during filling with the notes of value, the bag 12 can be transported through the opening of the frame 16 in a stepwise manner.

The receiving unit 400 includes a substantially U-shaped tub 402 for receiving the bag 12. The U-shaped tub 402 comprises a carrier element 408, two side elements 404, 406 and a rear wall 410. The side elements 404, 406 are arranged transversely to the carrier element 408 at the longitudinal edges of the carrier element 408. The rear wall 410 is arranged orthogonally to the side elements 404, 406 and the carrier element 408 at the rear side of the receiving unit 400. The two side elements 404, 406, the carrier element 408 as well as the rear wall 410 have recesses by which the weight of the receiving unit 400 is reduced and thus the handling is made easier. One of these recesses is exemplarily identified with the reference sign 412.

As already stated, the empty bag 12 is put over the frame 16 and a part of the U-shaped tub 402 with its inside surface turned outside so that the outside surface of the bag 12 that is turned inside faces the outside surfaces of the side elements 404, 406 and the lower side of the carrier element 408. By filling the bag 12 with the notes of value, the outside-turned inside surface of the bag 12 is again turned inside and is pushed through the opening of the frame 16. The part of the bag 12 whose outside-turned inside surface is yet again turned inside is arranged within the frame 16 and within the U-shaped tub 402. The filled part of the bag 12 at least partially rests on the carrier element 408 of the U-shaped tub 402. By means of the side elements 404, 406 and the carrier element 408, the part of the bag 12 whose inside surface is turned outside and the part of the bag 12 whose inside surface is yet again turned inside are separated from each other so that impediments, in particular impediments caused in that the bag 12 gets caught during filling of the bag 12 with the notes of value are prevented.

The carrier element 408 has a spacer 414 which is arranged at the end of the U-shaped tub 402 facing the frame 16 on the upper side of the carrier element 408. The surface of the spacer 414 facing the frame 16 forms an upward inclination in the supply direction. The edge of the spacer 414 facing away from the carrier element 408 and the surface of the second closing element 20 facing the opening of the frame 16 preferably lie in one plane. By the spacer 414, the sliding of the bag 12 from the frame 16 into the U-shaped tub 402 is supported. In particular, it is prevented that the bag 12 gets caught on the edge of the carrier element 408 facing the frame 16.

Further, the receiving unit 400 comprises a slide 416 which is mounted on two rail arrangements 418, 420 movably in the direction of the double arrow P3. Each of the rail arrangements 418, 420 preferably comprises several rails mounted within one another and movable relative to each other in the direction of the double arrow P3 by means of balls. By means of such ball rail arrangements 418, 420, a displacement of the slide 416 in the direction of the double arrow P3 over a long displacement path is made possible, with the rail arrangement 418, 420 and the entire device 10 having a compact structure. By means of the rail arrangement 418, 420, a pulling out of the slide 416 and of the U-shaped tub 402 and thus also of the bag 12 out of the rack 14 is made possible. In this way, a filled bag 12 can easily be removed and a new empty bag 12 and a new frame 16 can be mounted easily.

The U-shaped tub 402 is pivotally connected to the slide 416 via an axis 422. By pivoting the tub 402 and the bag 12 received in the tub 402 relative to the slide 416, the removal of a filled bag 12 and the insertion of a new empty bag 12 and a new frame 16 are made easier. By the recess 412 in the rear wall 410 of the receiving unit 400, a handle is formed that serves to manually pull out the slide 416 of the rack 14. In the pulled-out position illustrated in FIGS. 5 and 6, the receiving unit 400 is pulled out of the rack 14. Alternatively or additionally, a separate handle, in particular a folding handle can be provided.

Figure 7:
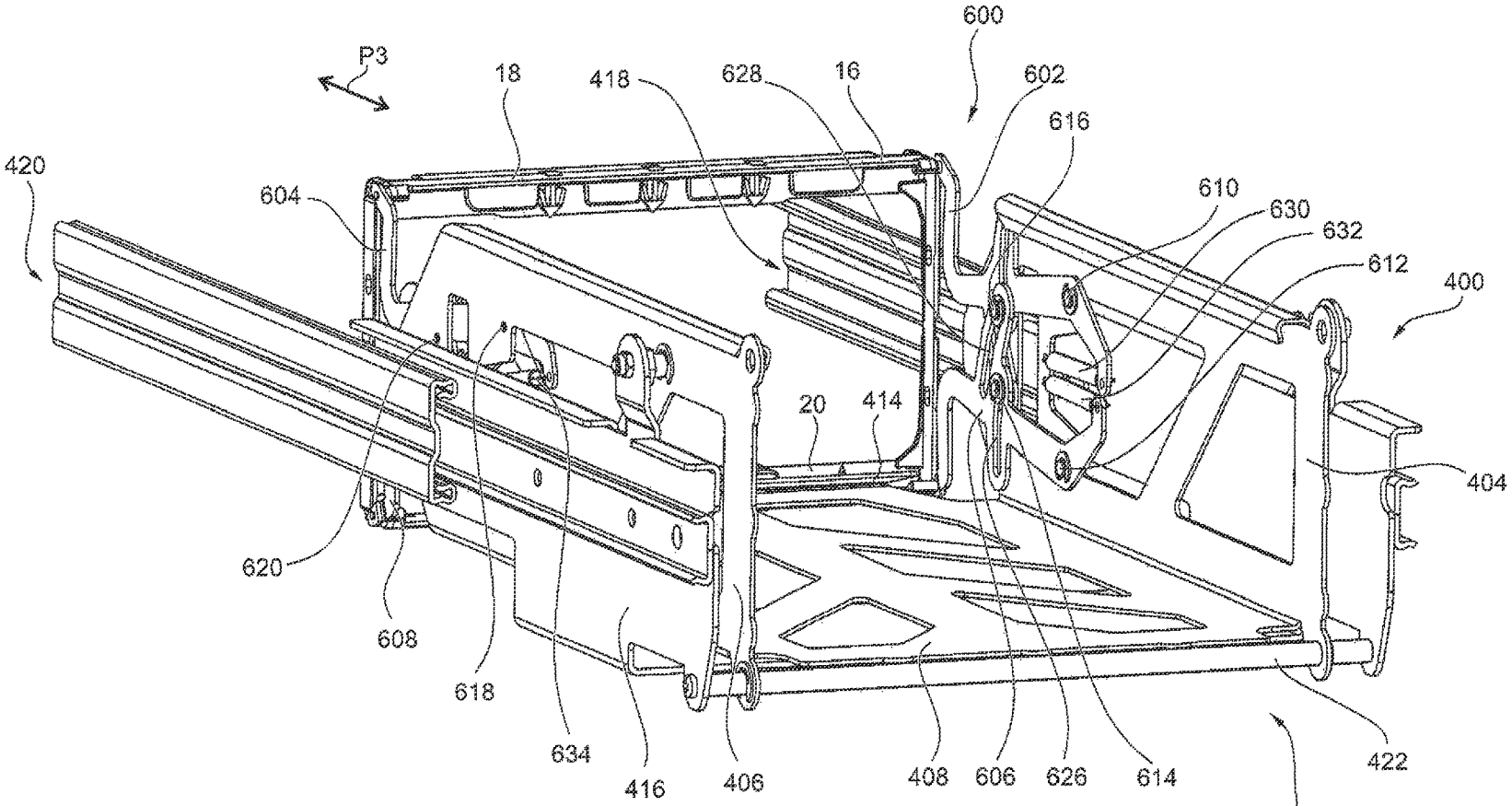
FIG. 7 is a further schematic perspective illustration of the receiving unit and the holding unit according to FIGS. 5 and 6 in a pulled-out position without a transport container.
Figure 8:
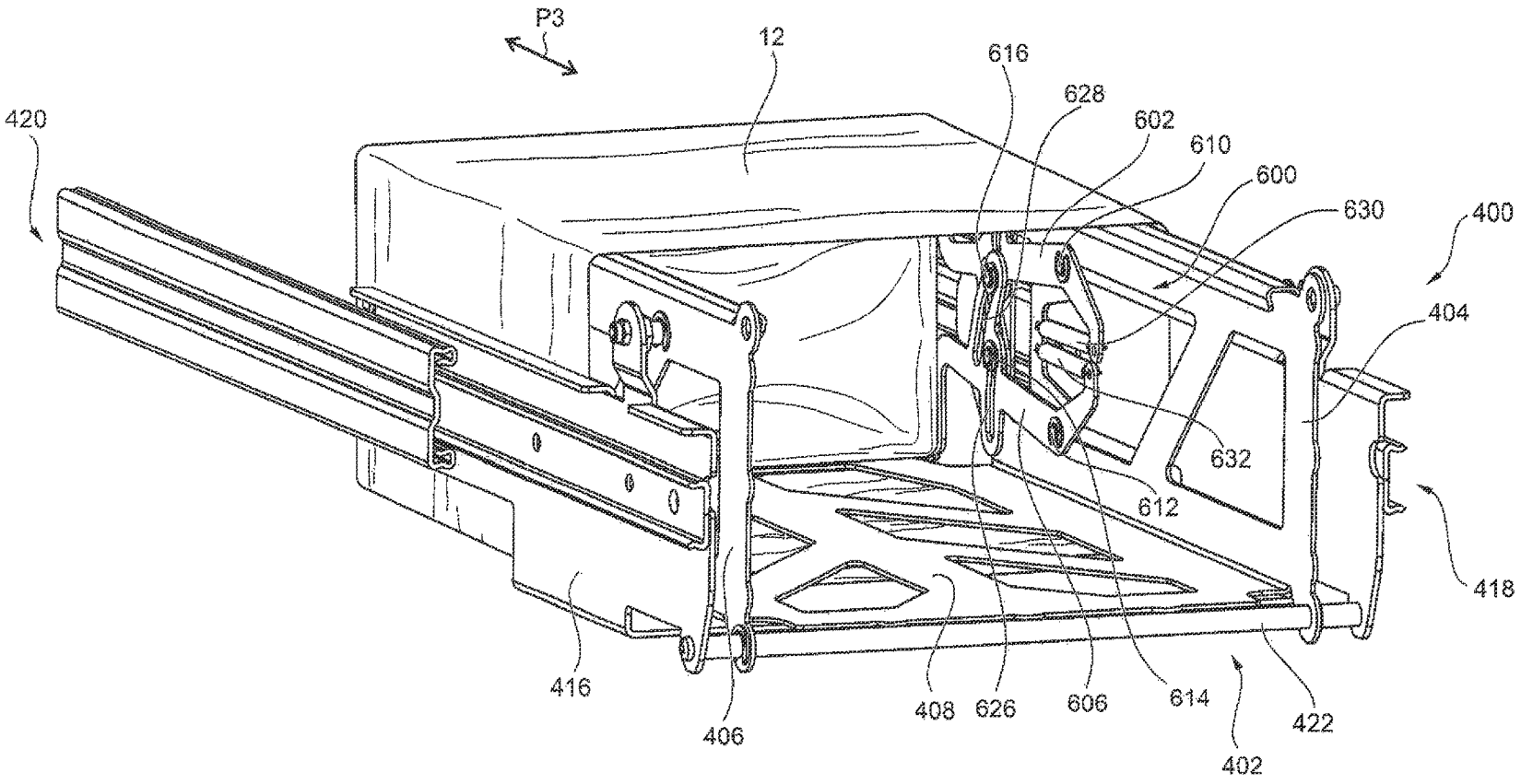
FIG. 8 is a further schematic perspective illustration of the receiving unit and the holding unit according to FIGS. 5 to 7 in the pulled-out position with a transport container.

In FIG. 7, a schematic perspective rear-view illustration of the receiving unit 400 and the holding unit 600 according to FIGS. 5 and 6 in the pulled-out position without a bag 12 is shown, and shown with a bag 12 in FIG. 8. The rear wall 410 of the U-shaped tub 402 is removed in FIGS. 7 and 8 for better clarity so that the holding unit 600 is better visible.

Figure 9:
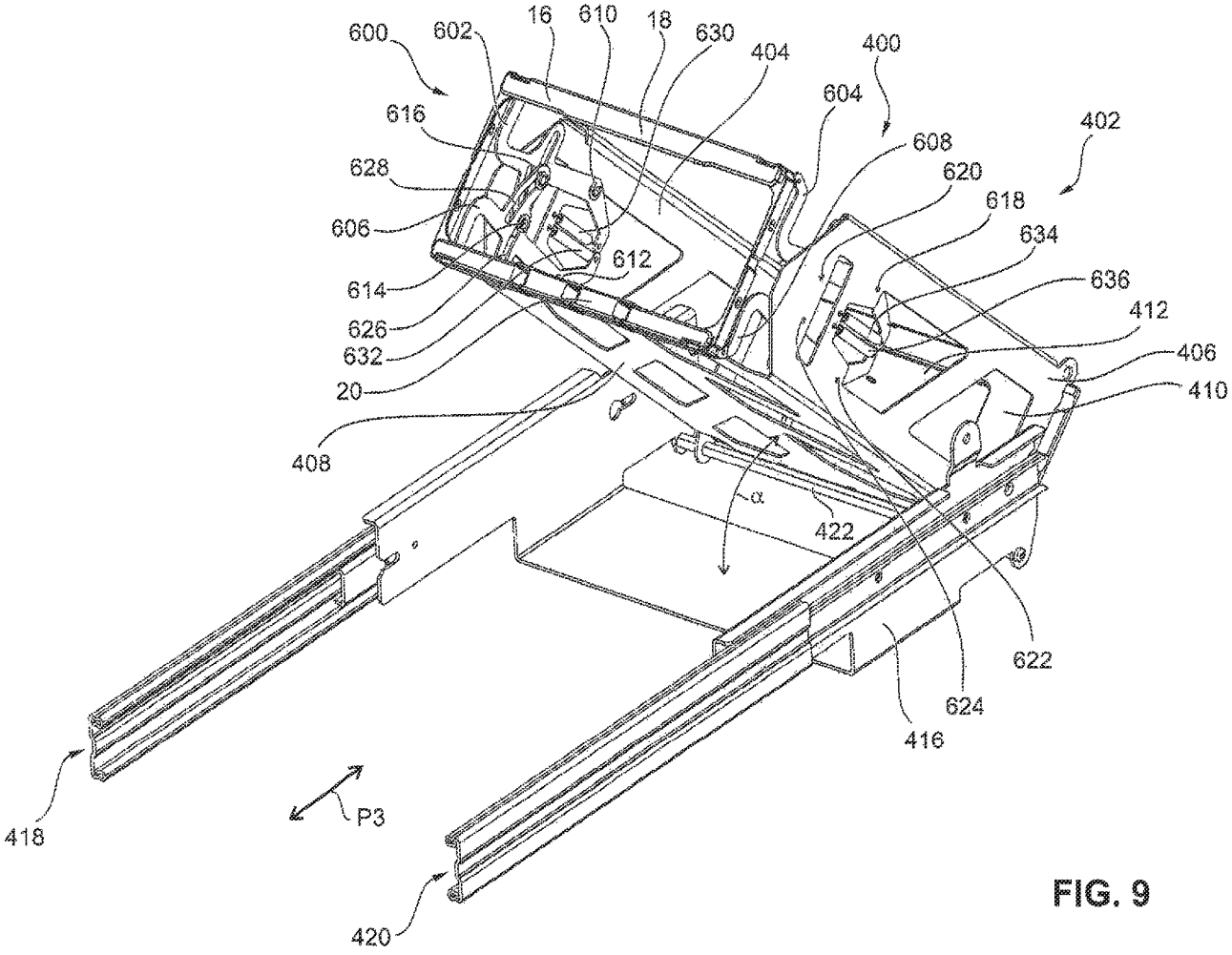
FIG. 9 is a schematic perspective illustration of the receiving unit and the holding unit according to FIGS. 5 to 8 in a removal position without a transport container.
Figure 10:
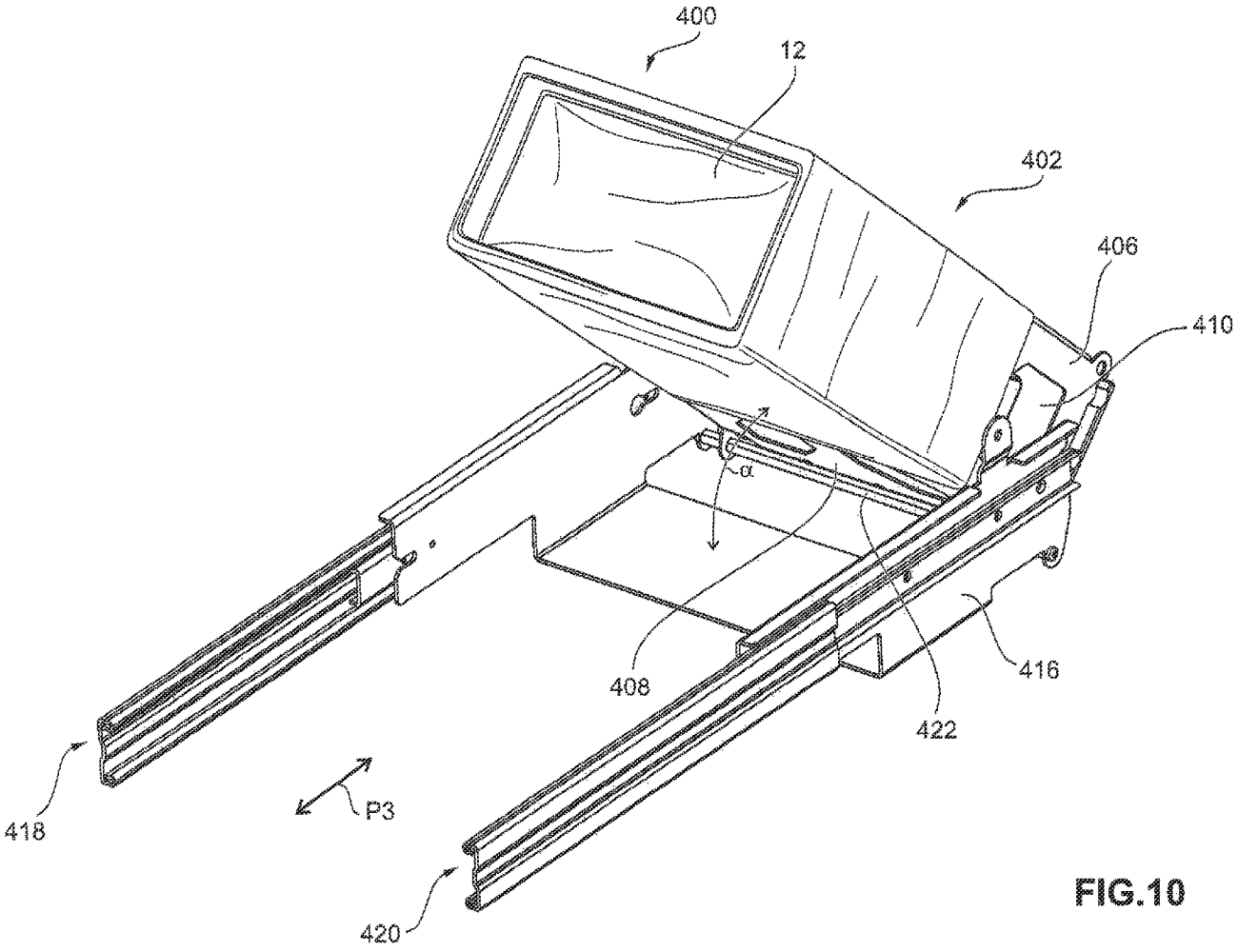
FIG. 10 is a schematic perspective illustration of the receiving unit and the holding unit according to FIGS. 5 to 9 in the removal position with a transport container.

In FIG. 9, a schematic perspective illustration of the receiving unit 400 and the holding unit 600 according to FIGS. 5 to 8 is shown in a pivoted position without a bag 12, and shown with a bag 12 in FIG. 10. The carrier element 408 is pivoted relative to the slide 416 by an angle $\alpha$. In the pivoted position, the angle $\alpha$ in particular has a value in the range between 20° and 60°, preferably in the range between 35° and 45°. Other embodiments are likewise possible, in which the angle $\alpha$ is in the range between 60° and 135°, preferably smaller than 90°.

The receiving unit 400 comprises a locking element not visible in FIGS. 9 and 10 by means of which the U-shaped tub 402 can be locked in a position pivoted relative to the slide 416 by an angle $\alpha$. In this way, it is achieved that during removal of a filled bag 12 or the insertion of a new bag 12 and a new frame 16, the tub 402 and thus also the holding unit 600 do not have to be manually held in the pivoted position. Thus, the handling is made easier.

Figure 11:
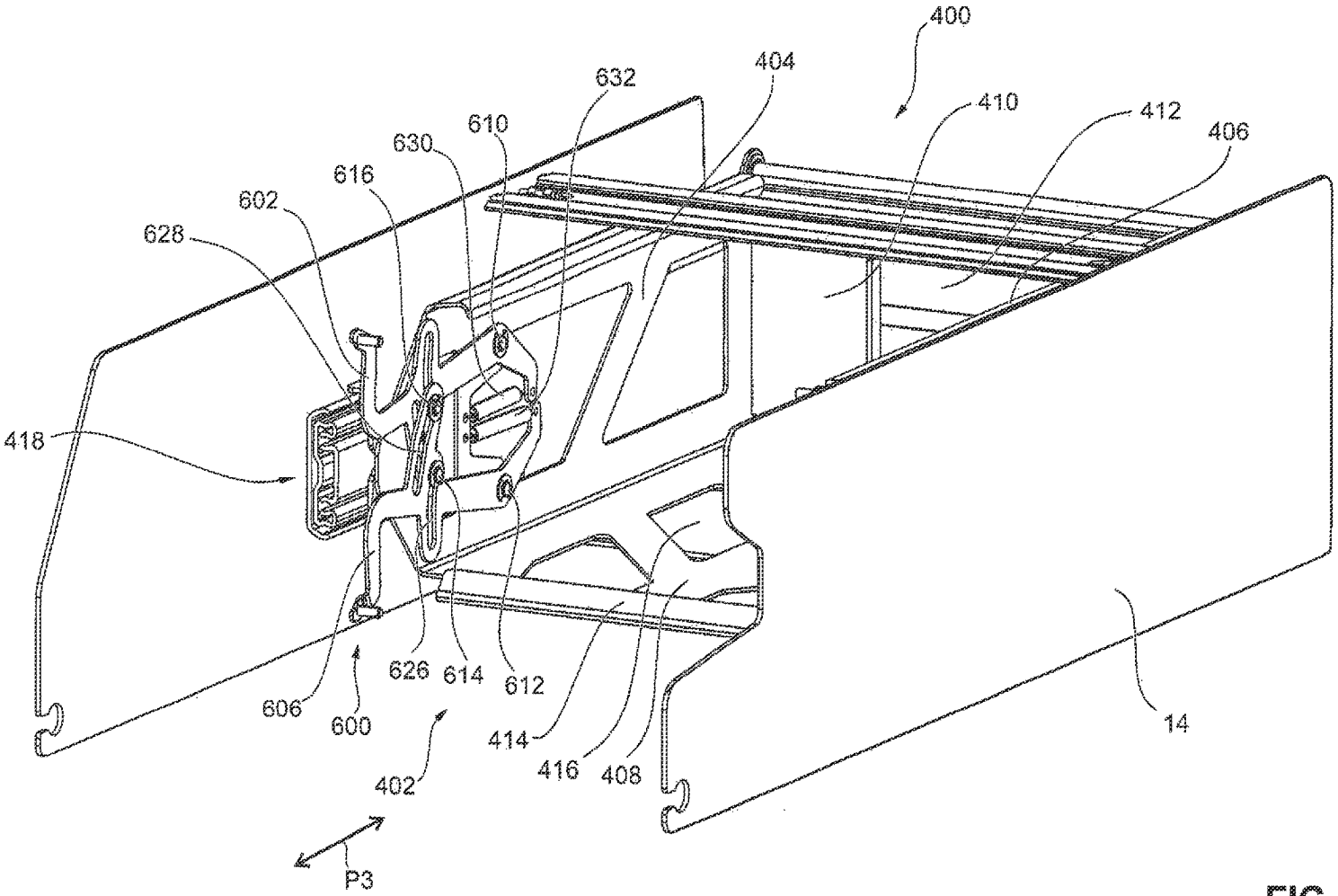
FIG. 11 is a schematic perspective illustration of the receiving unit and the holding unit according to FIGS. 5 to 10 in a pulled-in position without a transport container.
Figure 12:
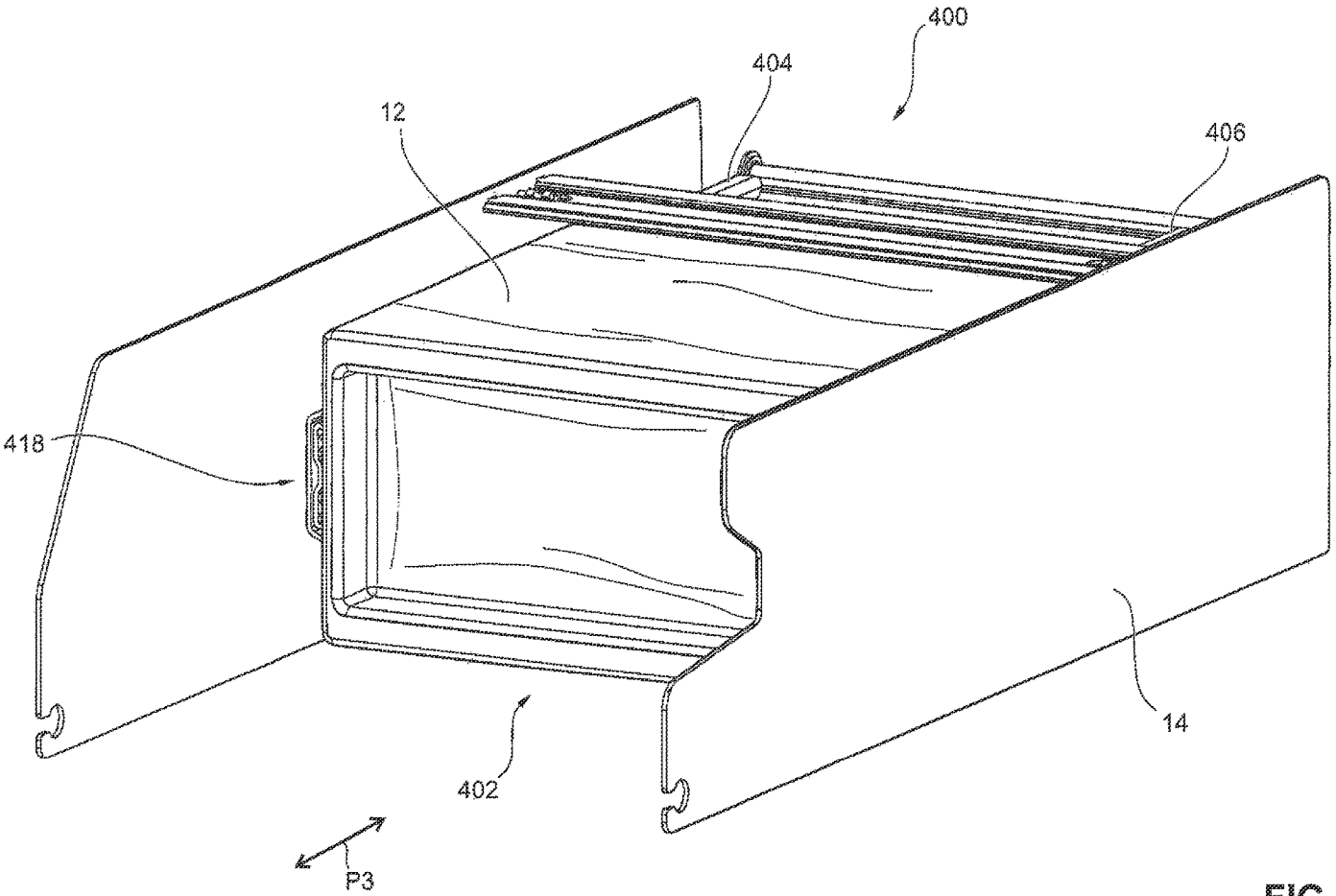
FIG. 12 is a schematic perspective illustration of the receiving unit and the holding unit according to FIGS. 5 to 11 in the pulled-in position with a transport container.

In FIG. 11, a schematic perspective illustration of the holding unit 600 and the receiving unit 400 according to FIGS. 5 to 10 in a pulled-in position is shown without a bag 12, and shown with a bag 12 in FIG. 12. In the pulled-in position, the U-shaped tub 402 and the holding unit 600 are completely pulled into the rack 14 so that in this position the notes of value can be supplied to the bag 12.

Figure 13:
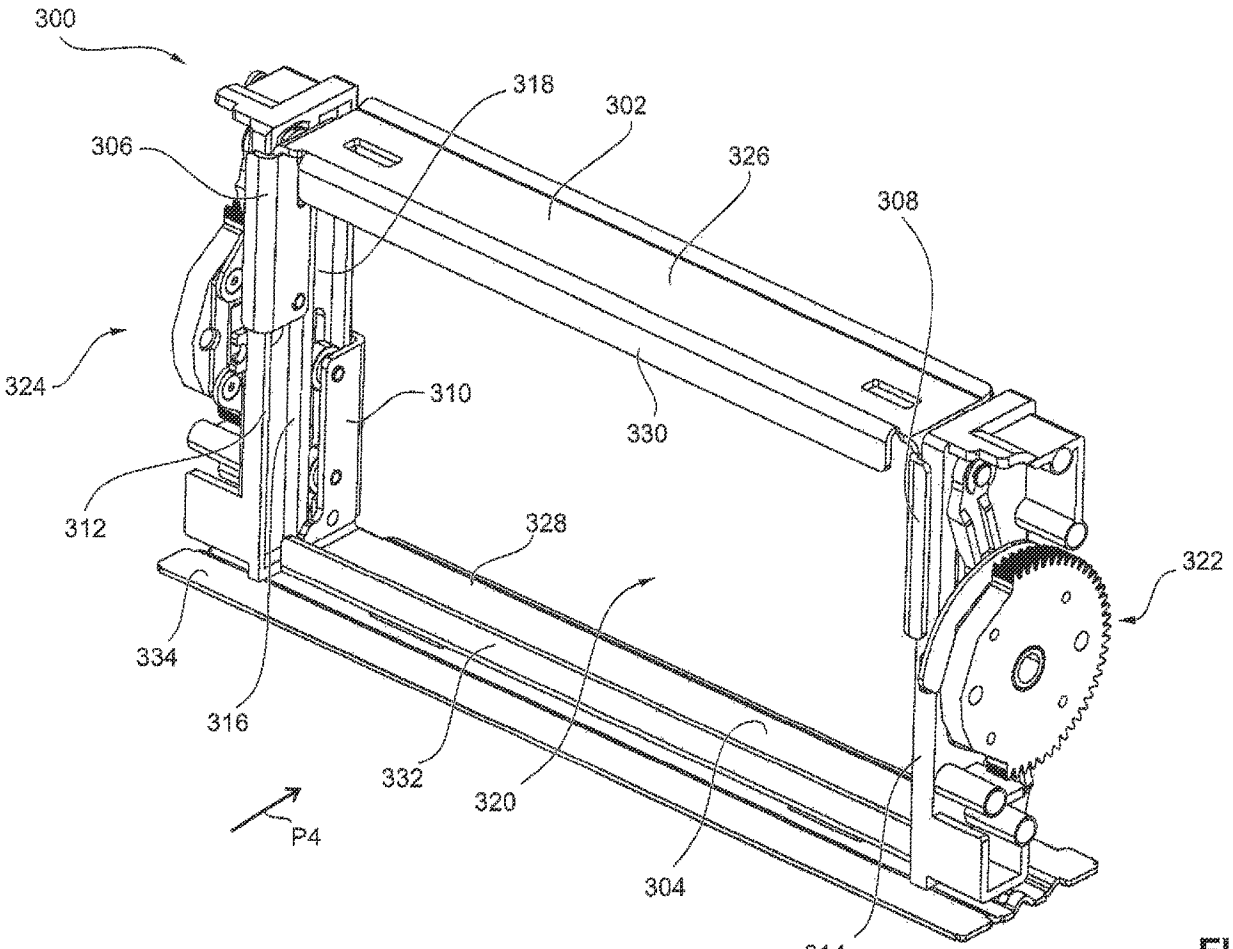
FIG. 13 is a schematic perspective illustration of a closure unit for closing the frame in a supply position.

In FIG. 13, a schematic perspective illustration of the closure unit 300 is shown in a supply position. The closure unit 300 is arranged between the stacking unit 200 and the receiving unit 400.

The closure unit 300 comprises a first press-on element 302, a second press-on element 304 and two side elements 312, 314. The press-on elements 302, 304 are arranged in parallel to each other and orthogonally to the side elements 312, 314. The side elements 312, 314 each have two groove-shaped recesses 316, 318. The press-on elements 302, 304 are firmly connected at each of their ends to a slide 306 to 310, which slides are arranged orthogonally to the respective press-on element 302, 304 and in parallel to the side elements 312, 314. The slides 306 to 310 and the respective press-on element 302, 304 are preferably formed as one piece. The slides 306 to 310 are mounted by means of two rolls each in one groove 316, 318 each of the side elements 312, 314 movably in the direction of the longitudinal axis of the groove-shaped recess 316, 318. In this way, each of the press-on elements 302, 304 can be displaced in the direction of the other press-on element 302, 304. The slides 306, 308 of the first press-on element 302 are arranged in the front groove-shaped recesses 316 of the side elements 312, 314 as viewed in the supply direction P4, whereas the slides 310 of the second press-on element 304 are arranged in the rear groove-shaped recesses 318 of the side elements 312, 314, as viewed in the supply direction P4. In this way, it is achieved that the slides 306, 308 of the first press-on element 302 and the slides 318 of the second press-on element 304 do not impede one another during displacement.

In the supply position of the closure unit 300 shown in FIG. 13, the press-on elements 302, 304 are moved away from each other such that between the press-on elements 302, 304 and the side elements 312, 314 an opening 320 is formed in which the frame 16 can be received. The frame 16 is held within the opening 320 by the holding elements 602 to 608 of the holding unit 600 such that the frame 16 and also the bag 12 put over the frame 16 preferably do not contact the closure unit 300 in the supply position. In this way, it is achieved that the bag 12 can be transported in a stepwise manner through the opening of the frame 16 during filling with the notes of value.

Figure 14:
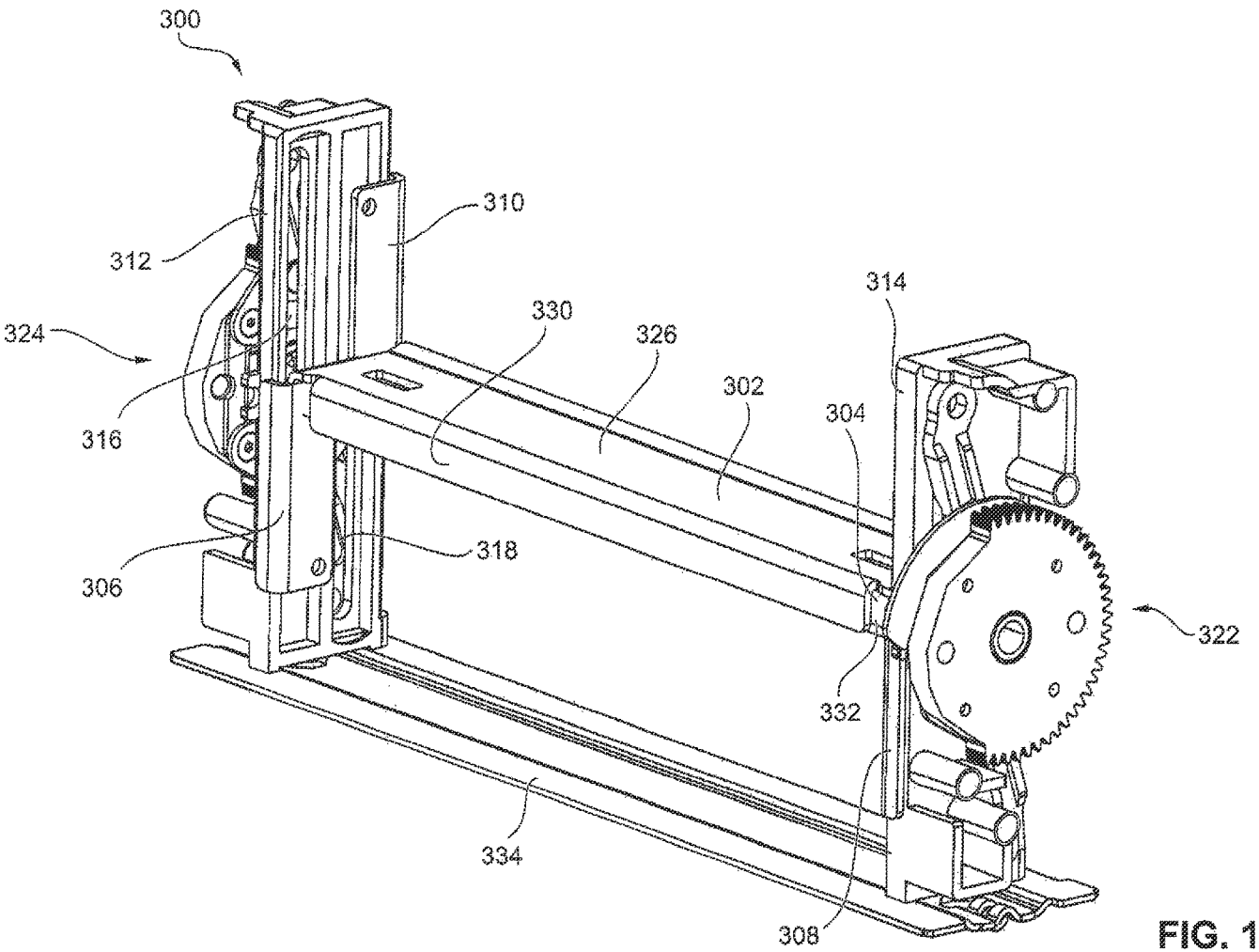
FIG. 14 is a schematic perspective illustration of the closure unit according to FIG. 13 in a closing position.

In FIG. 14, a schematic perspective illustration of the closure unit 300 according to FIG. 13 is shown in a closing position. In FIG. 14, the first press-on element 302 has been moved in the direction of the second press-on element 304, as compared to its position in FIG. 13. Likewise, the second press-on element 304 has been displaced in the direction of the first press-on element 302. Advantageously, the distance by which the first press-on element 302 has been displaced and the distance by which the second press-on element 304 has been displaced are identical. By moving the two press-on elements 302, 304 toward each other, a frame 16 arranged within the opening 320 of the holding unit 300 is closed. The first closing element 18 of the frame 16 is moved by the first press-on element 302 in the direction of the second closing element 20 of the frame 16 and the second closing element 20 is moved by means of the second press-on element 304 in the direction of the first closing element 18. The closing elements 18, 20 are moved toward each other until the first snap-in elements of the first closing element 18 snap into the second snap-in elements of the second closing element 20. In doing so, the side walls of the bag 12 are pierced by at least the first or the second snap-in elements and the opening of the bag 12 is thus at least closed so far that no notes of value received in the bag 12 can be taken out of the bag 12 without breaking the closure or the bag 12.

The force required for the snap-in of the first snap-in elements into the second snap-in elements is exerted onto the closing elements 18, 20 by the press-on elements 302, 304. For this, the press-on elements 302, 304 are moved toward each other by means of a drive unit. As a drive unit, in particular an electric motor, preferably a stepper motor is used. The force is transmitted by means of a closing mechanism 322, 324, in particular by means of a toggle joint mechanism from the drive unit onto the press-on elements 302, 304. Alternatively, instead of a toggle joint mechanism a link motion can be used as well.

The press-on elements 302, 304 preferably have an L-shaped cross-section so that they each comprise a first leg 326, 328 and a second leg 330, 332 that is arranged transversely to the respective first leg 326, 328. By the second legs 330, 332, an increase in the bending stiffness of the press-on elements 302, 304 is achieved so that the press-on elements 302, 304 do not bend during exertion of the forces required for the snap-in of the snap-in elements on the closing elements 318, 320. In this way, it is guaranteed that the first snap-in elements actually snap into the second snap-in elements. The press-on elements 302, 304 are in particular designed such that in the closing position the second legs 330, 332 are arranged behind one another in the supply direction P4. In this way, it is achieved that the closing elements 18, 20 can be moved toward each other sufficiently far that a snap-in of the snap-in elements takes place. After the frame 16 has been closed, the press-on elements 302, 304 are again moved into the supply position by the drive unit so that the closed bag 12 can be removed from the device 10.

The side elements 312, 314 are firmly connected to a mounting unit 334. The mounting unit 334 in turn is preferably firmly connected to the rack 14.

Figure 15:
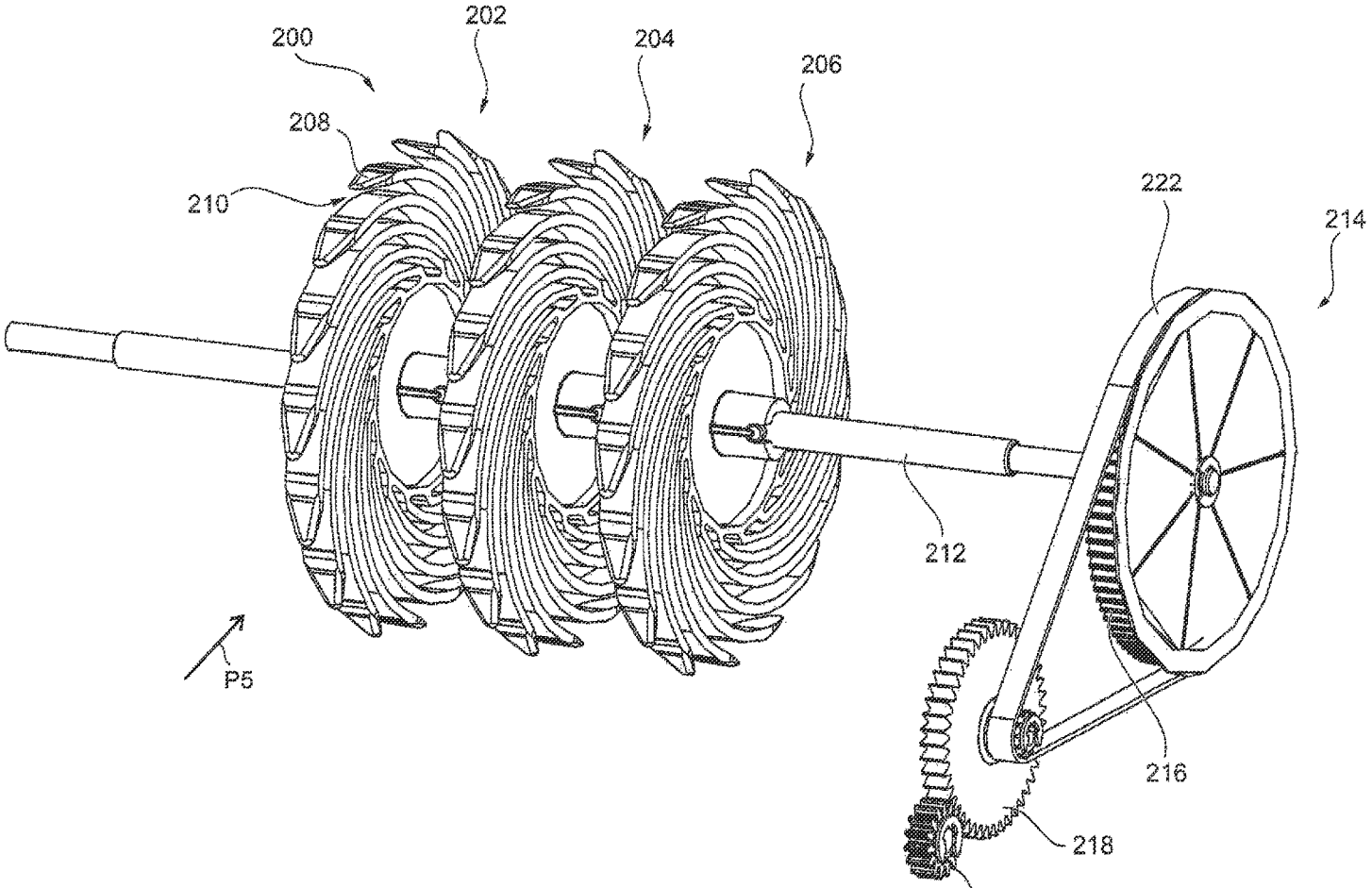
FIG. 15 is a schematic perspective illustration of a stacking unit.

In FIG. 15, a schematic perspective illustration of the stacking unit 200 is shown. The stacking unit 200 comprises three vane wheels 202 to 206. The vane wheels 202 to 206 are also referred to as stacking wheels. Each vane wheel 202 to 206 comprises a plurality of vanes, one of which is exemplarily identified with the reference sign 208. Between two adjacent vanes 208 of one vane wheel 202 to 206, one receiving area 210 each is formed, in which a part of a note of value is received. When the vane wheel 202 to 206 is rotated, the notes of value received between the vanes are likewise rotated. Such a vane wheel 202 to 206 is described in document EP 1 331 189 B1. The structure of a vane wheel 202 to 206 described in this document and the functioning are herewith incorporated into this description by reference.

The vane wheels 202 to 206 are arranged on an axis 212 and connected thereto in a rotationally fixed manner. The distance between two adjacent vane wheels 202 to 206 is preferably the same each time. The axis 212 and thus also the vane wheels 202 to 206 are rotated by a drive mechanism 214. The drive mechanism 214 comprises three gear wheels 216 to 220 and a toothed belt 222. The gear wheel 216 is connected to the axis 212 in a rotationally fixed manner. By a rotation of the gear wheels 220, 218 and thus a rotation of the toothed belt 222, the gear wheel 216 and thus also the axis 212 are rotated.

A note of value supplied to the stacking unit 200 in the supply direction P5 by means of the supply unit 100 is clamped between the vanes 208 of the vane wheels 202 to 206. Upon a rotation of the vane wheels 202 to 206, the note of value is correspondingly transported further and rotated by a preset angle, in particular by 90°, before it is stripped off of the vane wheels 202 to 206 by means of a strip-off unit 704 not illustrated in FIG. 15. In this way, the notes of value supplied to the stacking unit 200 are stacked on a support area likewise not shown in FIG. 15. Here, the notes of value are in particular stacked on the support area in an upright position on one of their longitudinal edges. Alternatively, the notes of value can also be stacked on the support area in an upright position on one of their short edges.

Figure 16:
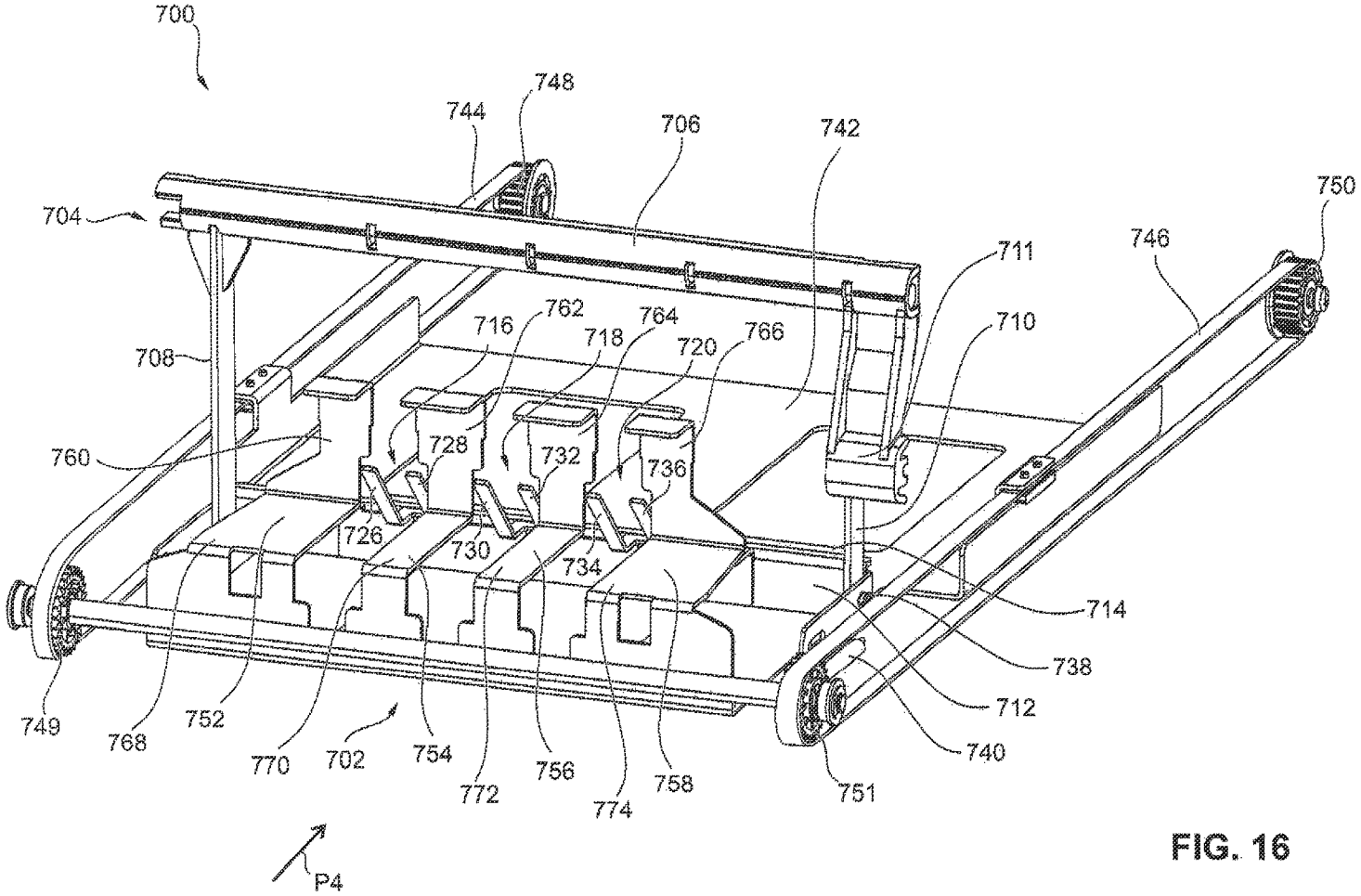
FIG. 16 is a schematic perspective illustration of a displacement unit for displacing a value note stack into the transport container.

In FIG. 16, a schematic perspective illustration of the displacement unit 700 is shown. The displacement unit 700 comprises a stuffing unit 702 and a strip-off unit 704.

Figure 17:
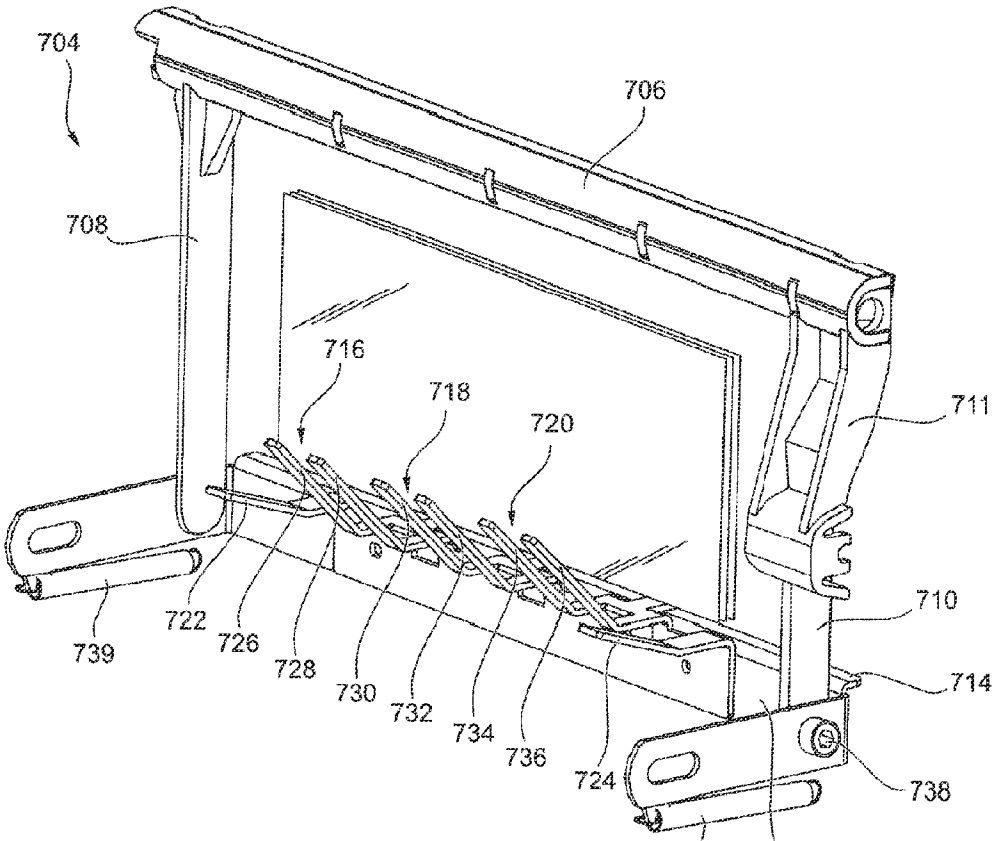
FIG. 17 is a schematic perspective illustration of a strip-off unit of the displacement unit according to FIG. 16.

In FIG. 17, a schematic perspective illustration of the strip-off unit 704 is shown. The strip-off unit 704 comprises a rotary element 706 rotatably mounted about its center axis and two side elements 708, 710 firmly connected to the rotary element 706 at the ends thereof. The side elements 708, 710 are arranged parallel to each other. The side element 710 comprises an engagement element 711, by means of which the strip-off unit 704 can be pivoted. Further, the strip-off unit 704 comprises a U-shaped element 712 and three strip-off elements 716 to 720 firmly connected to the U-shaped element 712 and two support elements 722, 724 likewise firmly connected to the U-shaped element 712. The three strip-off elements 716 to 720 are arranged such that each time two adjacent strip-off elements 716 to 720 preferably have the same distance to each other. The two support elements 722, 724 are arranged next to the two outer strip-off elements 716, 720, the distance between the first support element 722 and the strip-off element 716 and the distance between the second support element 724 and the strip-off element 720 preferably being the same. The strip-off elements 716 to 720 and the support elements 722, 724 are preferably formed as one piece.

The U-shaped element 712 comprises a bridge area 714. The bridge area 714 and those areas of the strip-off elements 716 to 720 and of the support elements 722 to 724 whose surfaces are arranged parallel to the bridge area 714 together form the support area on which the notes of value stripped off of the vane wheels 202 to 206 rest in a stacked manner on their longitudinal edges. For this, the notes of value received in the vane wheels 202 to 206 are stripped off of the vane wheels 202 to 206 by means of fingers 726 to 736 of the strip-off elements 716 to 720 and are stacked on the support area, the fingers projecting upward in an inclined manner.

The U-shaped element 712 is firmly connected to the side elements 708, 710 by means of two connecting elements 738, in particular by means of screws. When the rotary element 706 is rotated, the U-shaped element 712 is thus pivoted. The U-shaped element 712 is in particular pivoted between two positions. In a swiveled-on position, the strip-off unit 704 is arranged such that at least a part of the bridge area 714 projects into the opening of the bag 12. In this way, it is achieved both that the notes of value can be stacked on the support area of the strip-off unit 704 and also directly in the bag 12. By the bridge area 714, it is prevented that notes of value fall into a gap formed between the strip-off unit 704 and the frame 16 or, respectively, the bag 12 that is guided over the frame 16 and/or are clamped between the strip-off unit 704 and the frame 16 or, respectively, the bag 12, or get caught thereat. Alternatively, the strip-off unit 704 can be fashioned such that the U-shaped element 712 has no bridge area 714 and, in the swiveled-on position, is pressed against the frame 16 or, respectively, the bag 12 put over the frame 16 such that no notes of value are clamped between the strip-off unit 704 and the frame 16 or, respectively, the bag 12, or no gap exists between the strip-off unit 704 and the frame 16 or, respectively, the bag 12.

In the swiveled-away position, the strip-off unit 704 is pivoted such that the bridge area 714 does not project into the supply opening of the bag 12 so that the supply opening of the bag 12 can be closed by closing the frame 16. The strip-off unit 704 further comprises two springs 739, 740 by which the strip-off unit 704 is held in the swiveled-on position. For pivoting the strip-off unit 704 into the swiveled-away position, the strip-off unit 704 has to be pivoted against the spring force of the springs 739, 740.

Notes of value stacked by means of the stacking unit 200 on the support area of the strip-off unit 704 and/or in the opening of the bag 12 are pressed into the bag 12 by means of the stuffing unit 702. For this, the stuffing unit 702 is moved in the supply direction P4 and the stacked notes of value are pressed in the direction P4. Further, notes of value that might have already been pressed into the bag 12 beforehand are pressed further into the bag 12, and the bag 12 is transported further through the opening of the frame 16. The stuffing unit 702 comprises a slide 742 which at its both sides is firmly connected to two toothed belts 744, 746. The toothed belts 744, 746 are guided over two gear wheels 748 to 751. When the gear wheels 748 to 751 are rotated, the slide 746 is moved via the toothed belts 744, 746 in the supply direction P4 or, respectively, opposite to the supply direction P4.

Further, the stuffing unit 702 comprises four pressing elements 752 to 758. The pressing elements 752 to 758 each comprise a contact area 760 to 766 which, upon a displacement of the value note stack, contacts the note of value that has been supplied to the value note stack as the last note of value. The pressing elements 752 to 758 are arranged such that, when the value note stack is displaced into the bag 12, they can be moved through between the strip-off elements 716 to 720 or, respectively, between the strip-off element 716 and the first support element 722 or, respectively, between the strip-off element 720 and the second support element 724.

When the value note stack is displaced into the bag 12, it slides on the support area of the strip-off unit 704. Each of the vane wheels 202 to 206 of the stacking unit 200 is arranged between the two fingers 726 to 736 of the strip-off elements 716 to 720. The stuffing unit 702 can be displaced into the bag 12 by the length of the areas 768 to 774 at a maximum. Therefore, the areas 768 to 774 of the pressing elements 752 to 758 of the stuffing unit 702 are at least as long as the minimum distance by which the notes of value at least have to be moved into the bag 12 with respect to the opening of the bag 12 so that the frame 16 can be closed in a problem-free manner.

In an alternative embodiment of the invention, the displacement unit 700 can also comprise more or less than four pressing elements 752 to 758 and/or more or less than three strip-off elements 716 to 720. Likewise, the stacking unit 200 can also have more or less than three vane wheels 202 to 206.

Figure 18:
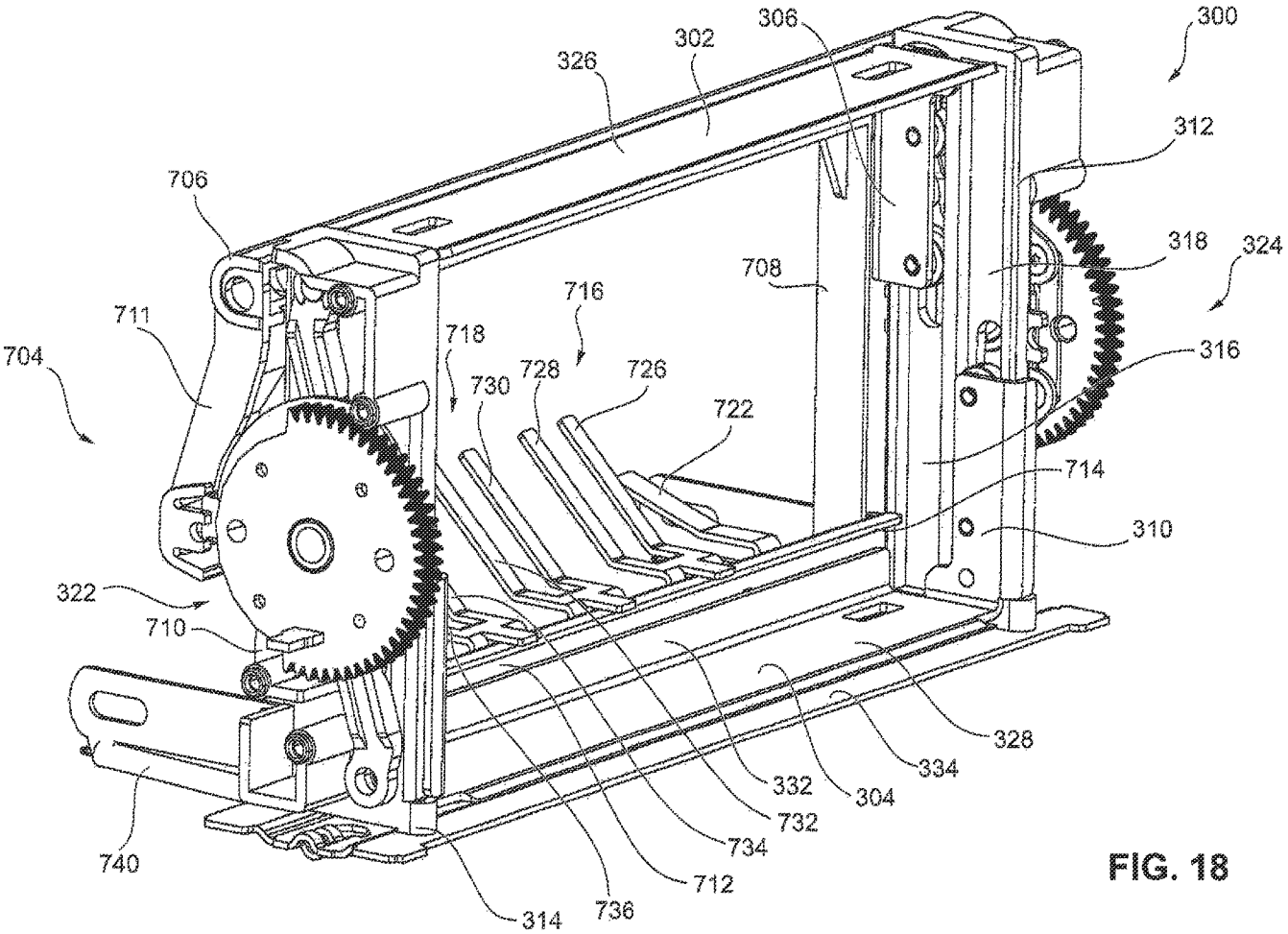
FIG. 18 is a schematic perspective illustration of the closure unit and the strip-off unit in a swiveled-on position.

In FIG. 18, a schematic perspective illustration of the closure unit 300 and the strip-off unit 704 is shown, the strip-off unit 704 being illustrated in the swiveled-on position. In this swiveled-on position, the bridge area 714 of the strip-off unit 704 projects at least in part into the supply opening 320 of the closure unit 300.

Figure 19:
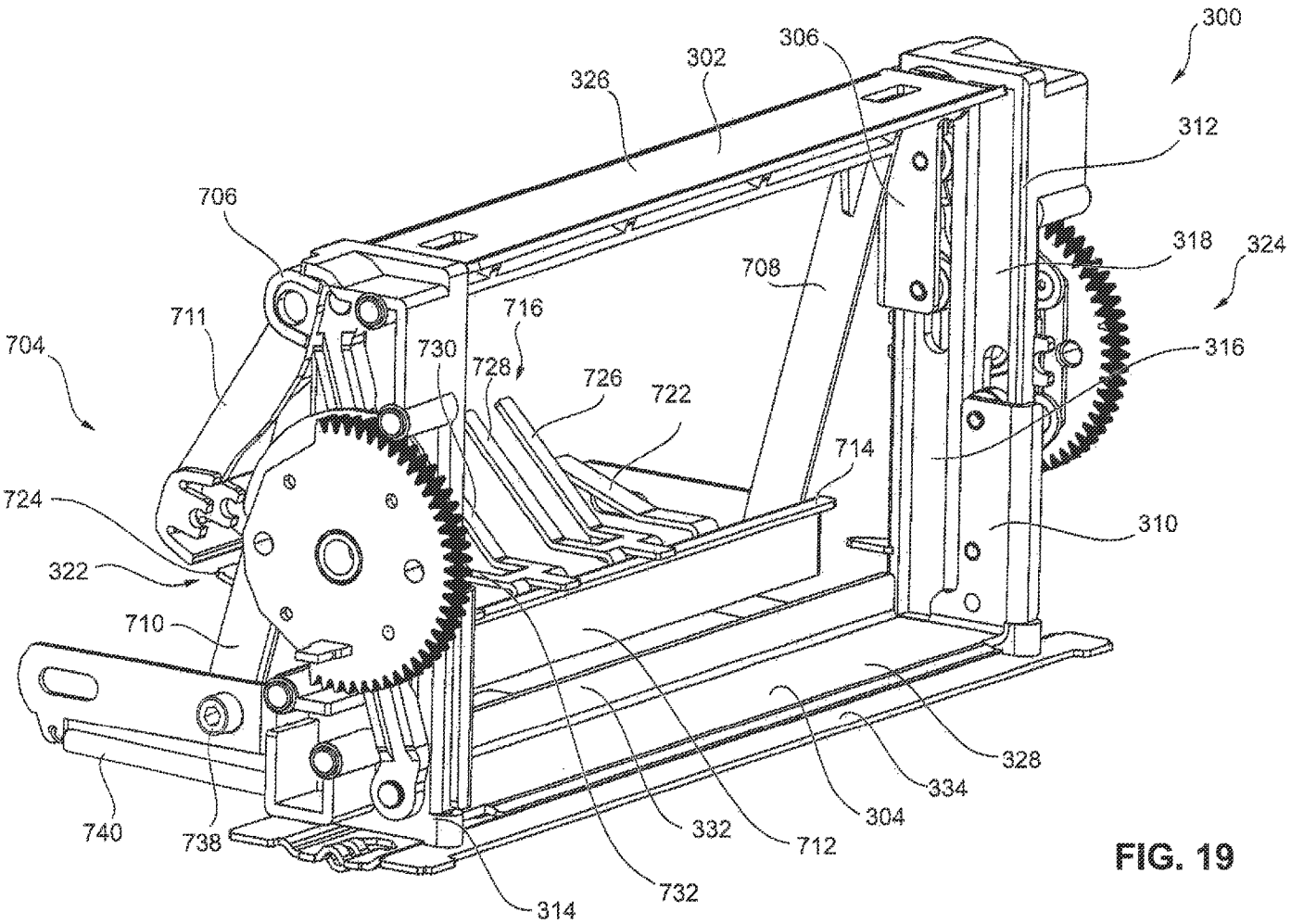
FIG. 19 is a schematic perspective illustration of the closure unit and the strip-off unit in a swiveled-away position.

In FIG. 19, a schematic perspective illustration of the closure unit 300 and the strip-off unit 704 is shown in the swiveled-away position. In the swiveled-away position, the bridge area 714 of the strip-off unit 704 does not project into the supply opening 320 of the closure unit 300 so that a frame 16 arranged within the supply opening 320 can be closed by moving the press-on elements 302, 304 toward each other.

Figure 20:
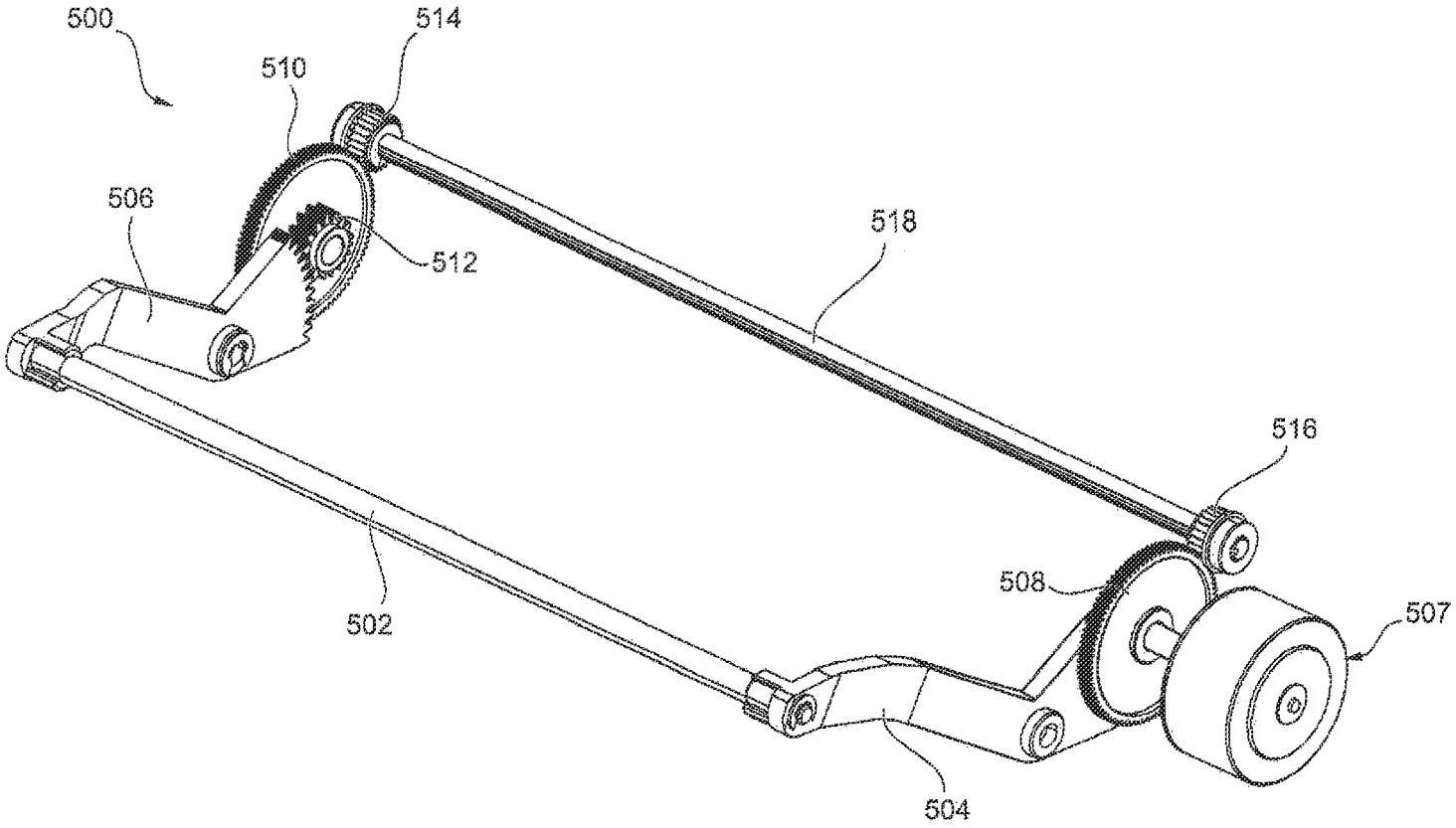
FIG. 20 is a schematic perspective illustration of a retaining unit.

In FIG. 20, a schematic perspective illustration of a retaining unit 500 for holding notes of value transported into the bag 12 in the orientation in which they have been supplied to the bag 12 is shown. The retaining unit 500 comprises a retaining element 502. The retaining element 502 is in particular a rod which is firmly clamped at its both ends into two lever elements 504, 506.

Further, the retaining unit 500 comprises a drive unit 507, in particular an electric motor. By means of the drive unit 507, a gear wheel 508 is driven. By means of a rotary axis 518 and two gear wheels 514, 516 that are arranged on this rotary axis 518 and connected thereto in a rotationally fixed manner, a further gear wheel 510 is driven. A small gear wheel 512 is connected to this gear wheel 510 in a rotationally fixed manner so that the small gear wheel 512 is likewise rotated when the gear wheel 510 is rotated. Likewise, the large gear wheel 508 is connected to a further small gear wheel not visible in FIG. 20, which, upon rotation of the large gear wheel 508, is likewise rotated.

The lever elements 504, 506 each have a toothing at the end opposite to the retaining element 502, which toothing is engaged with the small gear wheels 512. When the gear wheels 508 to 512 are rotated, the lever elements 504, 506 and thus also the retaining element 502 are pivoted.

Figure 21:
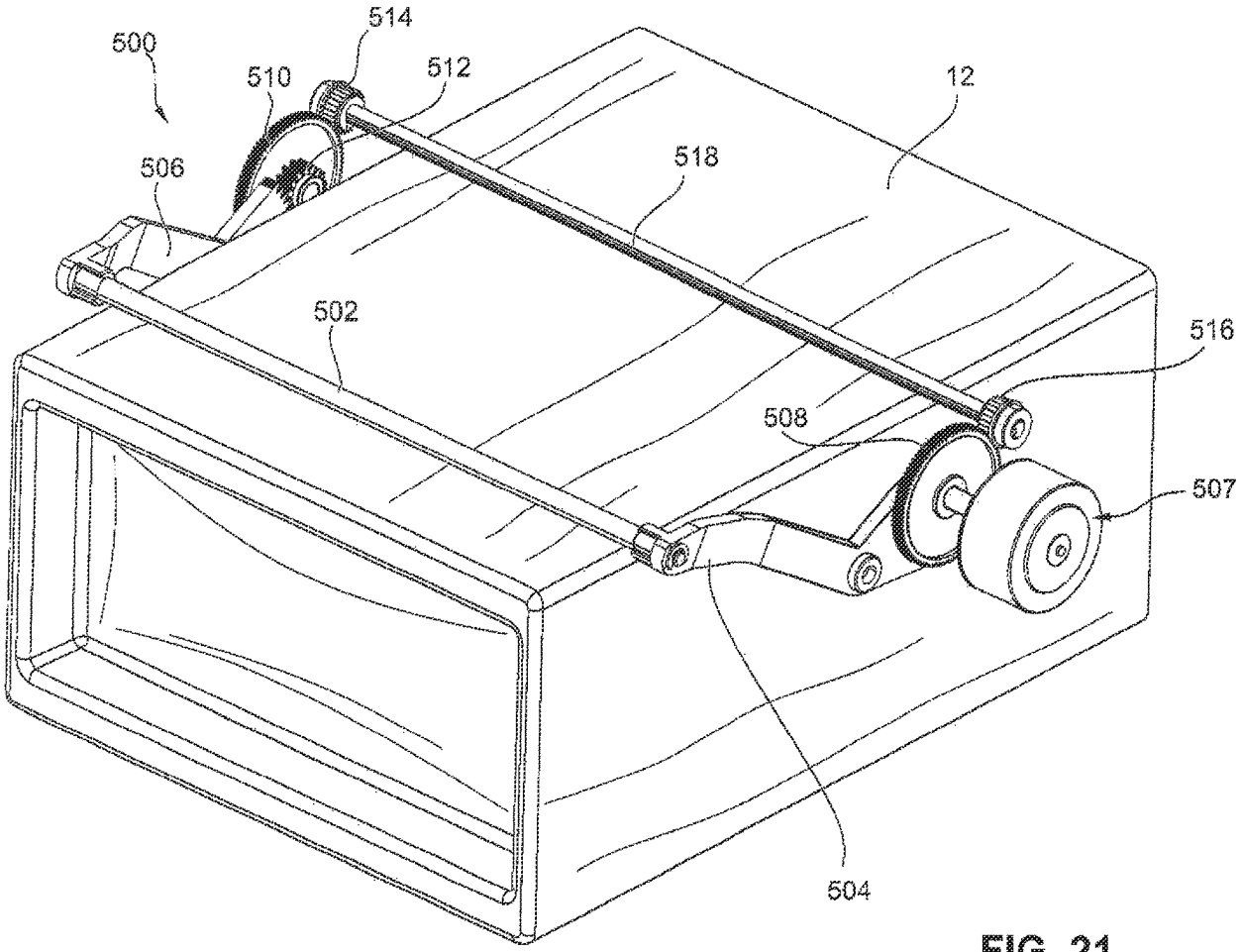
FIG. 21 is a schematic perspective illustration of the retaining unit according to FIG. 20 and of a transport container in a supply position.

In FIG. 21, a schematic perspective illustration of the retaining unit 500 according to FIG. 12 in a supply position as well as a bag 12 are shown. In this supply position, the retaining element 502 is arranged such that the bag 12 is not deformed by the retaining element 502 or at least only deformed so far that the remaining opening of the bag 12 is large enough that the notes of the value can be supplied to the bag 12. The retaining element 502 is in particular arranged such that it does not contact the bag 12.

Figure 22:
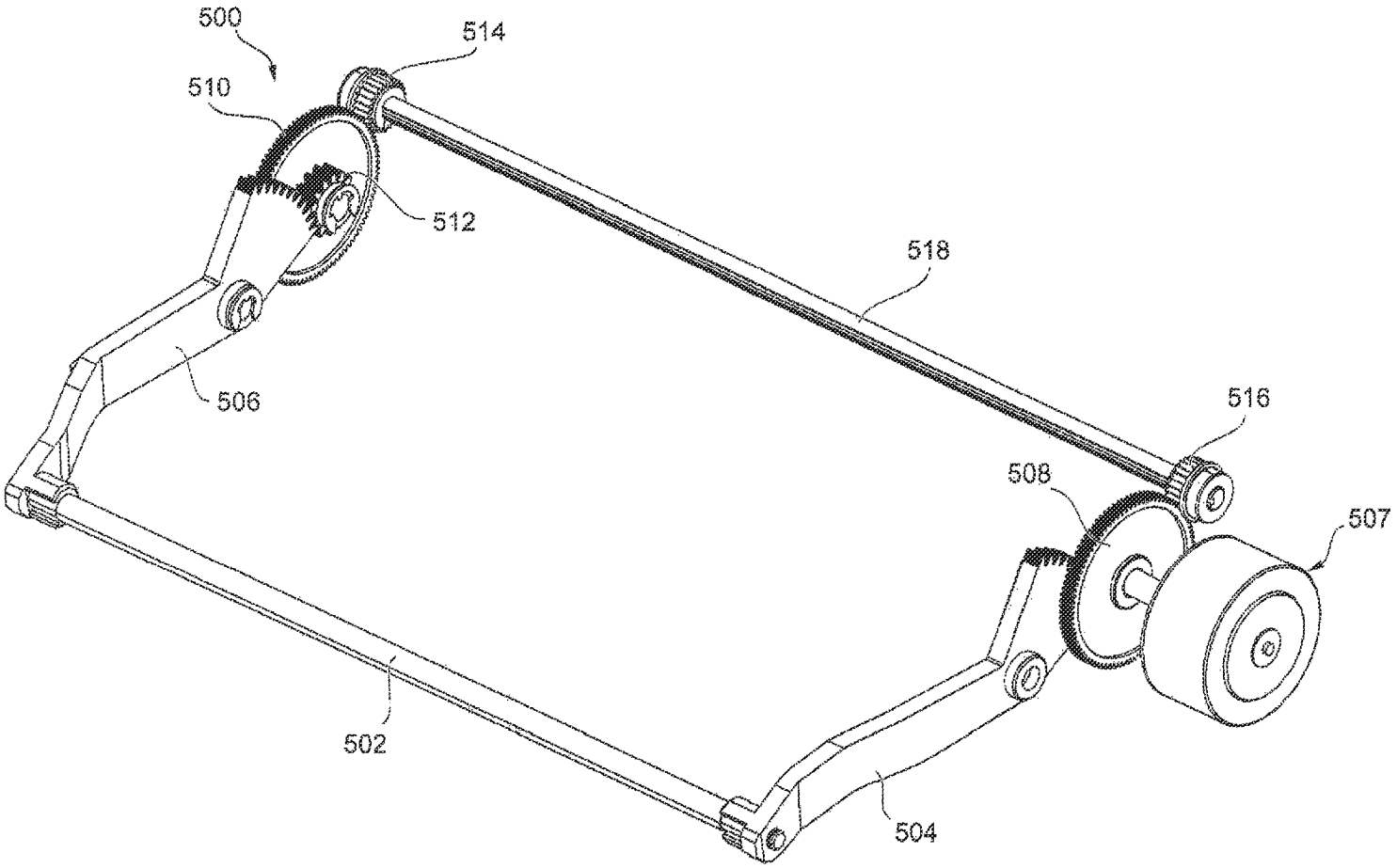
FIG. 22 is a schematic perspective illustration of the retaining unit according to FIGS. 20 and 21 in a retaining position.

In FIG. 22, a schematic perspective illustration of the retaining unit 500 according to FIGS. 20, 21 is shown in a retaining position. Compared to the supply position illustrated in FIG. 21, the retaining element 502 is pivoted in the direction of the bag 12. The retaining element 502 deforms the bag 12 such that its cross-section is reduced such that the notes of value supplied to the bag 12 are kept in the orientation in which they have been pressed into the bag 12 by means of the stuffing unit 702 into a closing position for closing the bag 12 by means of the frame 16. In particular, a tipping over of the notes of value opposite to the supply direction P4 is prevented. The retaining element 502 deforms the bag 12 in particular such that it presses into the bag 12. Instead of using a rod as a retaining element 502 that presses into the bag 12 over its entire width, one short rod each can also be arranged in the lever elements 504, 506, which short rod only presses into the bag 12 in the lateral areas of the bag 12.

For filling the bag 12 with notes of value, at first a value note stack is created by means of the stacking unit 200, which stack rests on the support area of the strip-off unit 704 and/or in the bag opening 12. The value note stack comprises in particular about 150 notes of value. After the value note stack has been created by means of the stacking unit 200, the value note stack is pushed into the bag 12 by means of the stuffing unit 702. Here, the value note stack is only transported into the bag 12 so far that in the opening of the bag 12 there is enough free space available for the creation of a further value note stack. Such a displacement of the value note stack is also referred to as an intermediate stuffing operation.

When all notes of value to be received in the bag 12 are stacked in and/or in front of the bag 12, a so-called final stuffing operation takes place. During this operation, at first the stuffing unit 702 is moved into the bag 12 as far as possible. Subsequently, the retaining element 502 of the retaining unit 500 is pivoted such that it assumes the retaining position and thus prevents that the notes of value received in the bag 12 tip over opposite to the supply direction P4.

Thereafter, the frame 16 is partially pressed together by means of the closing unit 300, i.e. the closing elements 18, 20 are moved toward each other. The closing elements 18, 20 are however only moved toward each other so far that the stuffing unit 702 can still be moved out of the bag 12. By the partial compression of the frame 16, a partial wrapping around the note of value that has been supplied to the bag 12 as the last note of value is achieved and thus a tipping over of the notes of value in the bag 12 opposite the supply direction P4 is prevented.

The strip-off unit 704 is swiveled-away so that the bridge area 714 of the strip-off unit 704 is no longer arranged within the supply opening 320. The swivel movement is in particular caused by means of the drive unit of the closure unit 300. For this, the drive unit of the closure unit 300 is connected to the strip-off unit 704 via a cam disc.

Thereafter, the stuffing unit 702 is completely moved out of the bag 12, and subsequently the frame 16 is completely closed so that the first snap-in elements of the first closing element 18 snap into the second snap-in elements of the second closing element 20. Thereafter, the U-shaped tub 402 of the receiving unit 400 is pulled out of the rack 14 and pivoted upward so that the closed bag 12 filled with notes of value can be removed from the device 10.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A device for filling a thin-walled transport container having an opening with notes of value, comprising:

a supply unit for supplying the notes of value, a stacking unit for stacking the supplied notes of value, and a closure unit for closing the opening of the thin-walled transport container, including a first press-on element and a second press-on element that is arranged parallel to the first press-on element, wherein, during closing of the closure unit, the first press-on element exerts a force on a first closing element of the closure unit, and the second press-on element exerts a force on a second closing element of the closure unit and/or the supports the second closing element, and wherein the first press-on element is mounted for closing the closure unit it is movable in a direction of the second press-on element, wherein the closure unit is closed by bringing the two closing elements together.

2. The device according to claim 1, wherein the press-on elements are mounted such that for closing the closure unit the first press-on element is movable in the direction of the second press-on element and the second press-on element is movable in the direction of the first press-on element.

3. The device according to claim 1, wherein the first press-on element and the second press-on element each comprise a stiffening element for increasing the bending stiffness.

4. The device according to claim 1, wherein the first press-on element and the second press-on element each have an L-shaped profile.

5. The device according to claim 4, wherein a first leg of the first press-on element and a first leg of the second press-on element are arranged behind each other when the first press-on element and the second press-on element are arranged in an end position in which they have been moved toward each other.

6. The device according to claim 1, further comprising a drive unit to move the press-on elements.

7. The device according to claim 6, wherein the first press-on element and the second press-on element are connected to the drive unit via at least one toggle joint.

* * * * *